US007978027B2

(12) United States Patent
Satoh et al.

(10) Patent No.: US 7,978,027 B2
(45) Date of Patent: Jul. 12, 2011

(54) COPLANAR WAVEGUIDE RESONATOR AND COPLANAR WAVEGUIDE FILTER USING THE SAME

(75) Inventors: Kei Satoh, Yokosuka (JP); Daisuke Koizumi, Zushi (JP); Shoichi Narahashi, Yokohama (JP)

(73) Assignee: NTT DoCoMo, Inc., Tokyo (JP)

( * ) Notice: Subject to any disclaimer, the term of this patent is extended or adjusted under 35 U.S.C. 154(b) by 489 days.

(21) Appl. No.: 12/057,471

(22) Filed: Mar. 28, 2008

(65) Prior Publication Data

US 2008/0238578 A1 Oct. 2, 2008

(30) Foreign Application Priority Data

Mar. 29, 2007 (JP) ..... 2007-086973

(51) Int. Cl.
*H01P 1/203* (2006.01)
*H01P 7/08* (2006.01)

(52) U.S. Cl. ..... 333/204; 333/219

(58) Field of Classification Search ..... 333/202–205, 333/175, 176

See application file for complete search history.

(56) References Cited

U.S. PATENT DOCUMENTS

| | | | |
|---|---|---|---|
| 3,600,711 | A | 8/1971 | Gerlack |
| 6,262,640 | B1 | 7/2001 | Tsujiguchi |
| 7,245,195 | B2 | 7/2007 | Satoh et al. |
| 2007/0052502 | A1 | 3/2007 | Koizumi et al. |

FOREIGN PATENT DOCUMENTS

| | | |
|---|---|---|
| EP | 1 760 823 A1 | 3/2007 |
| JP | 11-220304 | 8/1999 |
| JP | 2005-223446 | 8/2005 |
| JP | 2007-74293 | 3/2007 |
| KR | 10-2006-0042937 | 5/2006 |
| KR | 10-2007-0027442 | 3/2007 |

OTHER PUBLICATIONS

Fang-Lih Lin, et al., "Coplanar Waveguide Bandpass Filter-A Ribbon-of-Brick-Wall Design", IEEE Transactions on Microwave Theory and Techniques, vol. 43, No. 7, Jul. 1995, pp. 1589-1596.

Jiafeng Zhou, et al., "Coplanar Quarter-Wavelength Quasi-Elliptic Filters Without Bond-Wire Bridges", IEEE Transactions on Microwave Theory and Techniques, vol. 52, No. 4, Apr. 2004, pp. 1150-1156.

Hideyuki Suzuki, et al., "A Low-Loss 5 GHz Bandpass Filter Using HTS Quarter-Wavelength Coplanar Waveguide Resonators", IEICE Trans. Electron, vol. E85-C, No. 3, Mar. 2002, pp. 714-719.

(Continued)

*Primary Examiner* — Benny Lee
*Assistant Examiner* — Gerald Stevens
(74) *Attorney, Agent, or Firm* — Oblon, Spivak, McClelland, Maier & Neustadt, L.L.P.

(57) ABSTRACT

A coplanar waveguide resonator (100*a*) has a center conductor (101) formed on a dielectric substrate (105) that has a line conductor (a center line conductor) (101*b*) extending in the input/output direction, a ground conductor (103) that is disposed on the dielectric substrate (105) across a gap section from the center conductor (101), and a line conductor (a base stub) (104) formed as an extension line from the ground conductor (103), and a part of the base stub (104) constitutes a line conductor (a first collateral line conductor) (104*a*) disposed in parallel with the center line conductor (101*b*).

8 Claims, 33 Drawing Sheets

OTHER PUBLICATIONS

Shry-Sann Liao, et al., "Novel Reduced-Size Coplanar-Waveguide Bandpass Filter Using the New Folded Open Stub Structure", IEEE Microwave and Wireless Components Letters, vol. 12, No. 12, XP-011066936, ISSN:1531-1309, Dec. 1, 2002, pp. 476-478.

Jiafeng Zhou, et al., "HTS Coplanar Meander-Line Resonator Filters With a Suppressed Slot-Line Mode", IEEE Transactions on Applied Superconductivity, vol. 14, No. 1, XP-011111342, ISSN: 1051-8223, Mar. 1, 2004, pp. 28-32.

S. Khireddine, et al., "Flat Group Delay Low Pass Filters Using Two CPW Topologies", Microwave Symposium Digest, XP-010845011, ISBN: 978-0-7803-8846-8, Jun. 12, 2005, pp. 2215-2218.

E. K. I. Hamad, et al., "L-Shaped Defected Ground Structure for Coplanar Waveguide", Antennas and Propagation Society Symposium, vol. 2B, XP-010859761, ISBN: 978-0-7803-8883-3, Jul. 3, 2005, pp. 663-666.

Office Action issued Aug. 16, 2010, in Korean Patent Application No. 10-2008-0028413 (with English-language translation).

a = 0.02mm, b = 0.25mm a = 0.04mm, b = 0.23mm a = 0.082mm, b = 0.19mm a = 0.12mm, b = 0.15mm a = 0.16mm, b = 0.11mm a = 0.20mm, b = 0.07mm a = 0.242mm, b = 0.03mm a = 0.01mm, b = 1.31mm a = 0.02mm, b = 1.30mm a = 0.04mm, b = 1.28mm a = 0.08mm, b = 1.24mm a = 0.12mm, b = 1.20mm a = 0.16mm, b = 1.16mm a = 0.20mm, b = 1.12mm a = 0.24mm, b = 1.08mm a = 0.28mm, b = 1.04mm

COPLANAR WAVEGUIDE RESONATOR AND COPLANAR WAVEGUIDE FILTER USING THE SAME

BACKGROUND OF THE INVENTION

1. Field of the Invention

The present invention relates to a coplanar waveguide resonator and a coplanar waveguide filter using the same. More specifically, it relates to miniaturization of the same.

2. Description of the Related Art

Recently, a coplanar waveguide filter using one or more coplanar waveguide resonators has been proposed as a filter used in a transceiver device for microwave or millimeter wave communications. A coplanar waveguide resonator has a line conductor (a center conductor) having an electrical length equivalent to a half wavelength or a quarter wavelength and a ground conductor disposed across a predetermined space from the center conductor that are formed on the same surface of a dielectric substrate. Thus, for example, the circuit pattern is formed on only one side of the dielectric substrate, and no via hole is needed to form a short-circuited stub. As a result, the coplanar waveguide resonator has advantages that the manufacturing process is simple and the conductor film can be formed at low cost.

FIG. 27 shows an exemplary conventional coplanar waveguide filter composed of a plurality of half-wavelength coplanar waveguide resonators connected in series with each other (see the non-patent literature 1). A coplanar waveguide filter 900 is formed by forming a ground conductor 903 on the entire surface of a dielectric substrate 905 having the shape of a rectangular plate by vapor deposition or sputtering, and patterning the ground conductor 903 by photolithographic etching, thereby forming half-wavelength coplanar waveguide resonators Q1, Q2, Q3 and Q4, each having a half-wavelength center conductor 901 with two open-circuited ends, that are connected in series with each other in the direction of extension of the half-wavelength center conductors 901. In this example, line conductors 902 formed between adjacent half-wavelength coplanar waveguide resonators connect the ground conductors 903 that are facing to one another in order to suppress an unwanted mode, such as the slotline mode. In FIG. 27, illustration of input/output terminals, which is formed at the opposite ends of the coplanar waveguide resonators (the left and right ends of the coplanar waveguide resonators when the drawing is viewed straight from the front), is omitted. In FIGS. 27 to 29, for the sake of simplicity, stereoscopic representation is partially omitted.

Non-patent literature 1: Jiafeng Zhou, Michael J. Lancaster, "Coplanar Quarter-Wavelength Quasi-Elliptic Filters Without Bond-Wire Bridges", IEEE Trans. Microwave Theory Tech., vol. 52, No. 4, pp. 1149-1156, April 2004

FIG. 28 shows another exemplary conventional coplanar waveguide filter composed of a plurality of quarter-wavelength coplanar waveguide resonators connected in series with each other (see the patent literature 1 and the non-patent literature 2, for example). A coplanar waveguide filter 910 is composed of quarter-wavelength coplanar waveguide resonators S1, S2, S3 and S4 having a quarter-wavelength center conductor 911, which is short-circuited to a ground conductor 903 at one end and open-circuited at the other end, connected in series with each other in the direction of extension of the quarter-wavelength center conductors 911 in such a manner that adjacent quarter-wavelength coplanar waveguide resonators are disposed in inverted orientations. In other words, two types of parts appear alternately in the coplanar waveguide filter 910, the one of two types being a part in which adjacent two quarter-wavelength coplanar waveguide resonators are disposed with the quarter-wavelength center conductors 911 thereof connected to a line conductor 912 that connects the ground conductors 903 facing to one another, and the other one of two types being a part in which adjacent two quarter-wavelength coplanar waveguide resonators are disposed with the open-circuited ends of the quarter-wavelength center conductors 911 thereof facing each other. Furthermore, to improve the coupling strength of a capacitive coupling part C at which the open-circuited ends of the quarter-wavelength center conductors 911 face each other, changing the shapes of the open-circuited ends at the capacitive coupling part C is permitted in such a manner that the area of the parts of the open-circuited ends facing each other increases. Patent literature 1: Japanese Patent Application Laid-Open No. H11-220304 Non-patent literature 2: H. Suzuki, Z. Ma, Y. Kobayashi, K. Satoh, S. Narahashi and T. Nojima, "A low-loss 5 GHz bandpass filter using HTS quarter-wavelength coplanar waveguide resonators", IEICE Trans. Electron., vol. E-85-C, No. 3, pp. 714-719, March 2002

As is apparent from comparison between the examples described above, for the same resonance frequency, the total length of the coplanar waveguide filter composed of a plurality of quarter-wavelength coplanar waveguide resonators connected in series with each other is shorter than that of the coplanar waveguide filter composed of a plurality of half-wavelength coplanar waveguide resonators connected in series with each other, because the quarter-wavelength center conductors of the quarter-wavelength coplanar waveguide resonators have an electrical length equivalent to a quarter wavelength shorter than that of a half wavelength.

Furthermore, there is a known coplanar waveguide filter structure shown in FIG. 29 in which the quarter-wavelength center conductors of the quarter-wavelength coplanar waveguide resonators have a stepped impedance structure to reduce the total length of the coplanar waveguide filter (see the non-patent literature 1).

The total length of the coplanar waveguide filter composed of a plurality of coplanar waveguide resonators connected in series with each other in the direction of the connection (referred to simply as the total length of the coplanar waveguide filter, hereinafter) largely depends on the total length of each of the coplanar waveguide resonators forming the coplanar waveguide filter in the direction of the connection (referred to simply as the total length of the coplanar waveguide resonator, hereinafter). If the total length of the coplanar waveguide resonator is reduced, the total length of the coplanar waveguide filter composed of the coplanar waveguide resonators is also reduced.

Although the quarter-wavelength coplanar waveguide resonator has a shorter total length than the half-wavelength coplanar waveguide resonator, the center conductor has to have a physical length corresponding to an electrical length equivalent to a quarter wavelength at a desired resonance frequency, and it is necessary to contemplate further reducing the total length of the quarter-wavelength coplanar waveguide resonator.

If the stepped impedance structure is used in the quarter-wavelength coplanar waveguide resonator, the total length of the coplanar waveguide resonator can be further reduced. However, the area of the center conductor is increased to increase the capacitance at the part at which the electrical field is concentrated, and therefore, it is difficult to reduce the footprint of the quarter-wavelength coplanar waveguide resonator on the dielectric substrate, while the total length of the coplanar waveguide resonator can be reduced.

Alternatively, the total length of the coplanar waveguide resonator can be further reduced if the center conductor is formed in a meander or spiral shape. However, the quarter-wavelength coplanar waveguide resonator requires an area on which the center conductor having a physical length corresponding to an electrical length equivalent to a quarter wavelength is disposed, and therefore, it is difficult to reduce the footprint of the quarter-wavelength coplanar waveguide resonator on the dielectric substrate.

As described above, even if the total length of the coplanar waveguide resonator can be reduced, the coplanar waveguide resonator cannot be sufficiently miniaturized.

SUMMARY OF THE INVENTION

In view of such circumstances, an object of the present invention is to provide a coplanar waveguide resonator smaller than conventional coplanar waveguide resonators and a coplanar waveguide filter using the same.

In order to solve the problems described above, a coplanar waveguide resonator according to the present invention comprises a center conductor formed on a dielectric substrate that has a line conductor (a center line conductor) extending in the input/output direction, a ground conductor that is disposed on the dielectric substrate with a gap section interposed between the ground conductor and the center conductor, and a line conductor (a base stub) formed as an extension line from the ground conductor, and a part of the base stub is a line conductor (a first collateral line conductor) disposed to have a uniform distance from the center line conductor. Furthermore, there is provided a coplanar waveguide filter having a plurality of such coplanar waveguide resonators connected in series with each other in such a manner that adjacent coplanar waveguide resonators are disposed in inverted orientations.

Effects of the Invention

The resonance frequency $f_1$ of the center conductor can be split and the center conductor can be made to resonate at a frequency $f_2$ lower than the frequency $f_1$ by providing the base stub having the first collateral line conductor. This means that, in designing and fabricating a coplanar waveguide resonator having the resonance frequency $f_2$, a center conductor having a physical length corresponding to an electrical length equivalent to a quarter wavelength or a half wavelength at the resonance frequency $f_1$ can be used. That is, according to the present invention, the total length of the coplanar waveguide resonator can be reduced. In addition to the reduction in total length, since the coplanar waveguide resonator has a simple structure in which the base stub is additionally provided in the gap section between the center line conductor and the ground conductor, the footprint of the coplanar waveguide resonator on the dielectric substrate is reduced. Therefore, according to the present invention, the coplanar waveguide resonator is downsized compared with conventional coplanar waveguide resonators, and since such coplanar waveguide resonators are used, the coplanar waveguide filter is also downsized compared with conventional coplanar waveguide filters.

DETAILED DESCRIPTION

Embodiments of the present invention will be described with reference to FIGS. 1 to 26. In FIGS. 1, 2A to 2G, 4 to 8, 9A to 9I and 11 to 13, illustration of input/output terminals actually disposed on the opposite ends of the coplanar waveguide resonator shown in each drawing (the left and right ends of the coplanar waveguide resonator when each drawing is viewed straight from the front) is omitted. In all the drawings except for FIG. 1, illustration of a dielectric substrate 105 is omitted.

Figure 1:
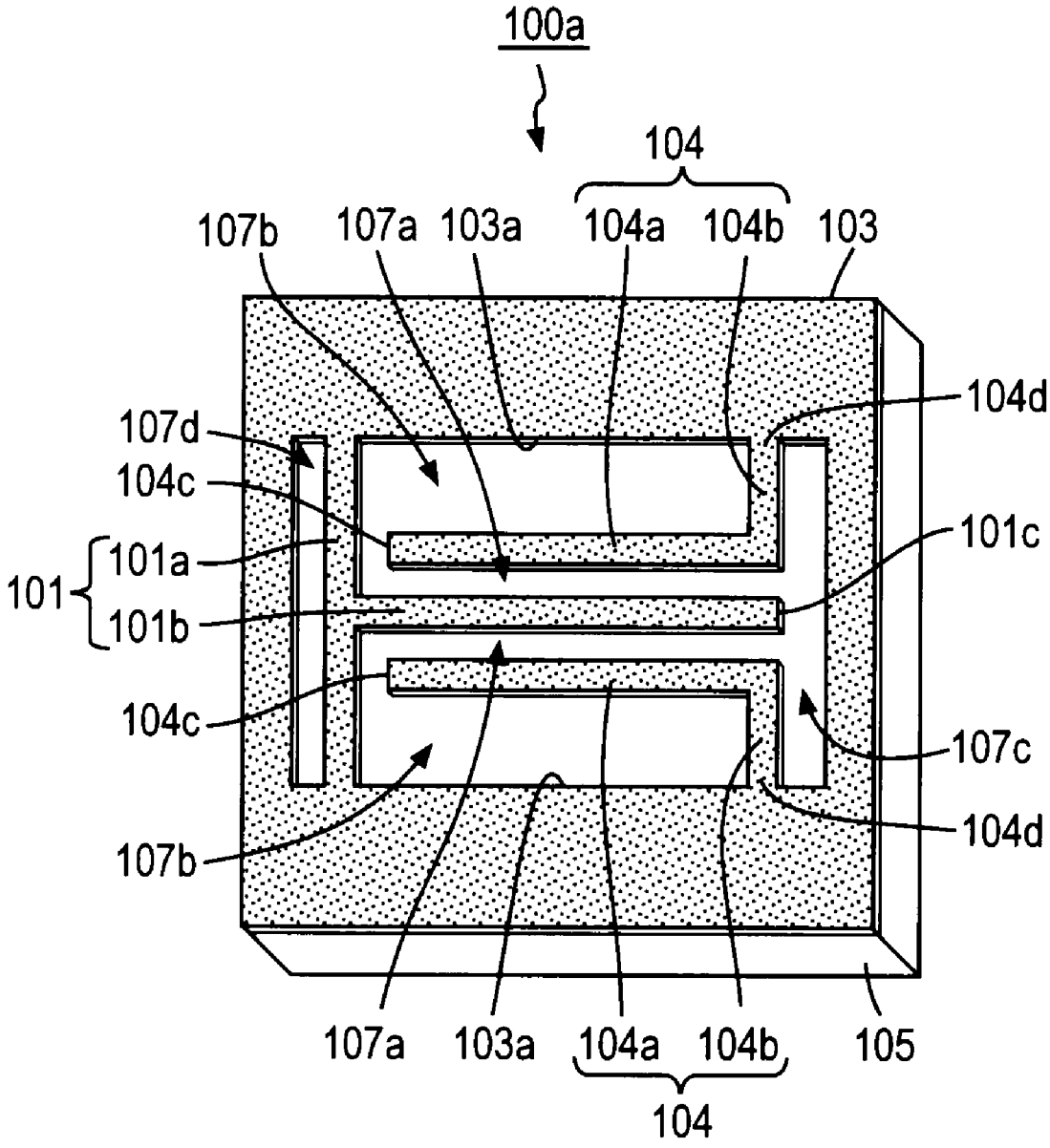
FIG. 1 is a perspective view of a quarter-wavelength coplanar waveguide resonator according to an embodiment of the present invention.
Figure 2A:
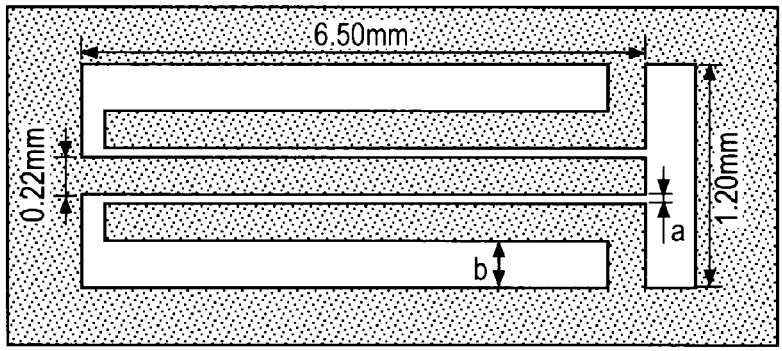
FIG. 2A is a plan view of a quarter-wavelength coplanar waveguide resonator used for an electromagnetic simulation.
Figure 2B:
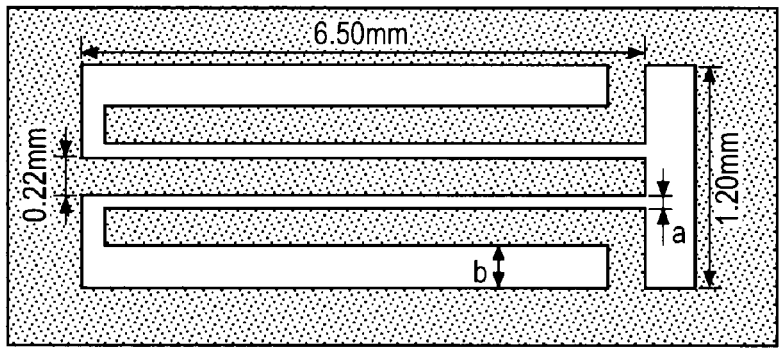
FIG. 2B is a plan view of a quarter-wavelength coplanar waveguide resonator used for an electromagnetic simulation.
Figure 2C:
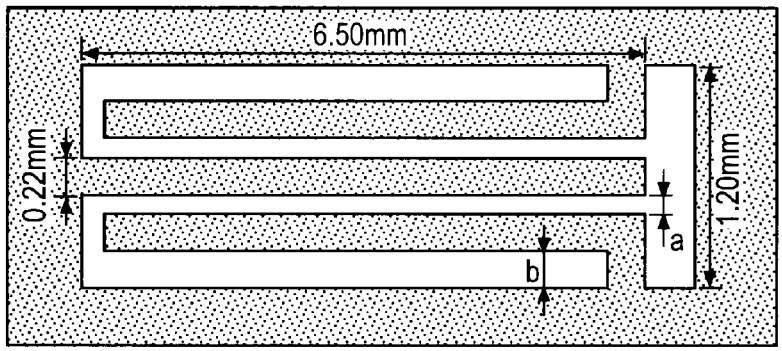
FIG. 2C is a plan view of a quarter-wavelength coplanar waveguide resonator used for an electromagnetic simulation.
Figure 2D:
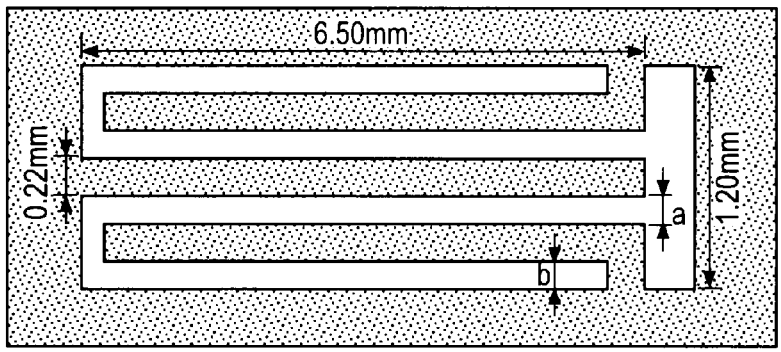
FIG. 2D is a plan view of a quarter-wavelength coplanar waveguide resonator used for an electromagnetic simulation.
Figure 2E:
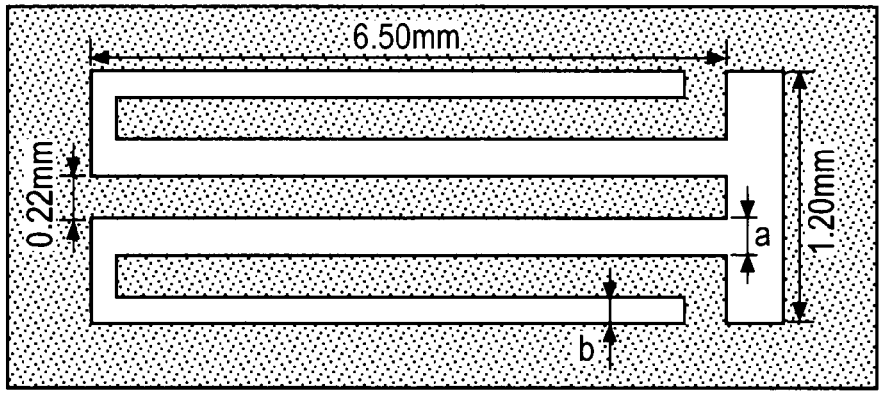
FIG. 2E is a plan view of a quarter-wavelength coplanar waveguide resonator used for an electromagnetic simulation.
Figure 2F:
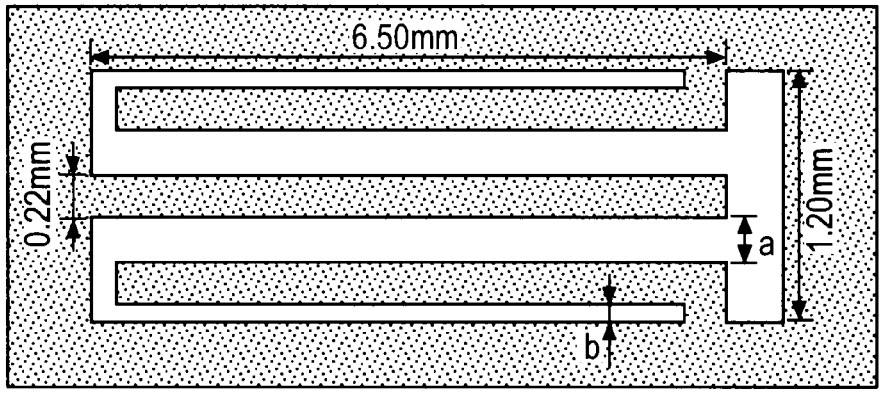
FIG. 2F is a plan view of a quarter-wavelength coplanar waveguide resonator used for an electromagnetic simulation.
Figure 2G:
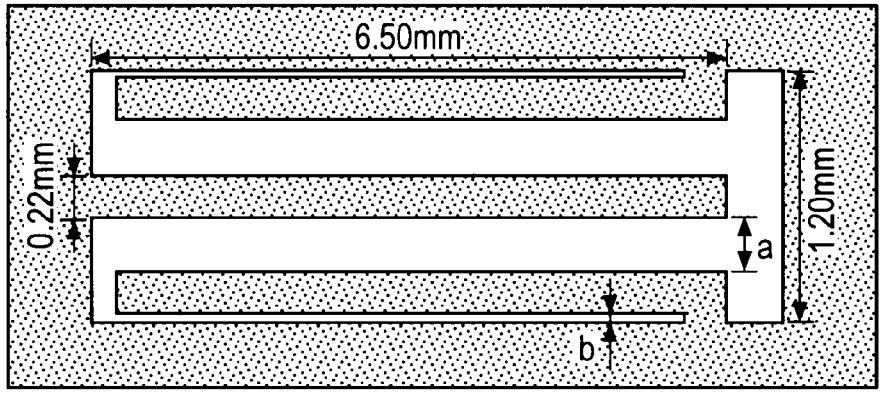
FIG. 2G is a plan view of a quarter-wavelength coplanar waveguide resonator used for an electromagnetic simulation.

FIG. 1 shows a coplanar waveguide resonator according to an embodiment of the present invention. In this embodiment, the coplanar waveguide resonator is a quarter-wavelength coplanar waveguide resonator. A quarter-wavelength coplanar waveguide resonator 100*a* shown in FIG. 1 comprises a ground conductor 103 disposed on a surface of a dielectric substrate 105 illustrated as a rectangular shape, and a center conductor 101 and two line conductors 104 formed by patterning the ground conductor 103 by etching.

The center conductor 101 is composed of a short-circuited line conductor 101*a*, which is a straight line conductor short-circuited to the ground conductor 103 at the opposite ends thereof, and a center line conductor 101*b*, which is a straight line conductor connected to the short-circuited line conductor 101*a* at one end and open-circuited at the other end. The physical lengths of the short-circuited line conductor 101*a* and the center line conductor 101*b* are determined so that the center conductor 101 has an electrical length equivalent to a quarter wavelength at a resonance frequency $f_1$. In other words, the center conductor 101 has a T-shape, and a gap section in which the center line conductor 101*b* is formed is formed on one side of the short-circuited line conductor 101*a*, and a gap section 107*d* in which the center line conductor 101*b* is not formed is formed on the other side of the short-circuited line conductor 101*a*.

In addition, the center conductor 101 is oriented with the longer side of the short-circuited line conductor 101*a* facing one of the input/output terminals (not shown) and an open-circuited end 101*c* of the center line conductor 101*b* facing the other of the input/output terminals (not shown). In other words, the center line conductor 101*b* of the center conductor 101 is extended in the input/output direction of the quarter-wavelength coplanar waveguide resonator 100*a*.

Each of the line conductors 104 is a line conductor formed as an extension of the ground conductor 103, or in other words, a line conductor short-circuited to the ground conductor 103 at one end and open-circuited at the other end. In this specification, the line conductors 104 are referred to as base stubs. In the quarter-wavelength coplanar waveguide resonator 100*a*, each base stub 104 has an L-shape and is composed of a straight line conductor 104*a*, which is disposed to have a uniform distance from the center line conductor 101*b* with a gap section 107*a* interposed therebetween (disposed in parallel with the center line conductor 101*b* in this embodiment), and a line conductor 104*b*, which connects one end of the line conductor 104*a* (the end opposite to an open-circuited end 104*c* of the base stub 104) and the ground conductor 103 to each other. In the following, the line conductors 104*a* will be referred to as first collateral line conductors.

The base stub 104 is connected to the ground conductor 103 at a root part 104*d* thereof. The root part 104*d* is located on the side of the open-circuited end 101*c* of the center conductor 101 and connected to a peripheral edge 103*a* of the ground conductor 103 that is parallel to the center line conductor 101*b*. The two base stubs 104 are disposed symmetrically on the opposite sides of the center line conductor 101*b* of the center conductor 101. In the quarter-wavelength coplanar waveguide resonator 100*a* shown in FIG. 1, the open-circuited end 111*c* of the center conductor 101 and the root parts 104*d* of the two base stubs 104 are located substantially in line with each other. However, such a positional relationship is not essential to the present invention. The open-circuited ends 104*c* of the two base stubs 104 face the short-circuited line conductor 101*a*.

In the quarter-wavelength coplanar waveguide resonator 100*a*, since the first collateral line conductors 104*a* are disposed close to the center line conductor 101*b* of the center conductor 101, the resonance frequency $f_1$ of the center conductor 101 can be split, and the center conductor 101 can be made to resonate at a frequency $f_2$ lower than the frequency $f_1$.

This will be described with reference to FIGS. 2A to 2G and 3.

FIGS. 2A to 2G show various configurations of the quarter-wavelength coplanar waveguide resonator 100*a* in which the width of the gap section 107*a*, the clearance (no-conductor region) between the center line conductor 101*b* and the first collateral line conductor 104*a* of the center conductor 101, differs. To simplify the configuration, the gap section 107*d* is omitted. Thus, the short-circuited line conductor 101*a* can be regarded as a part of the ground conductor 103, and the center conductor 101 constitutes the center line conductor 101*b* by itself.

Figure 3:
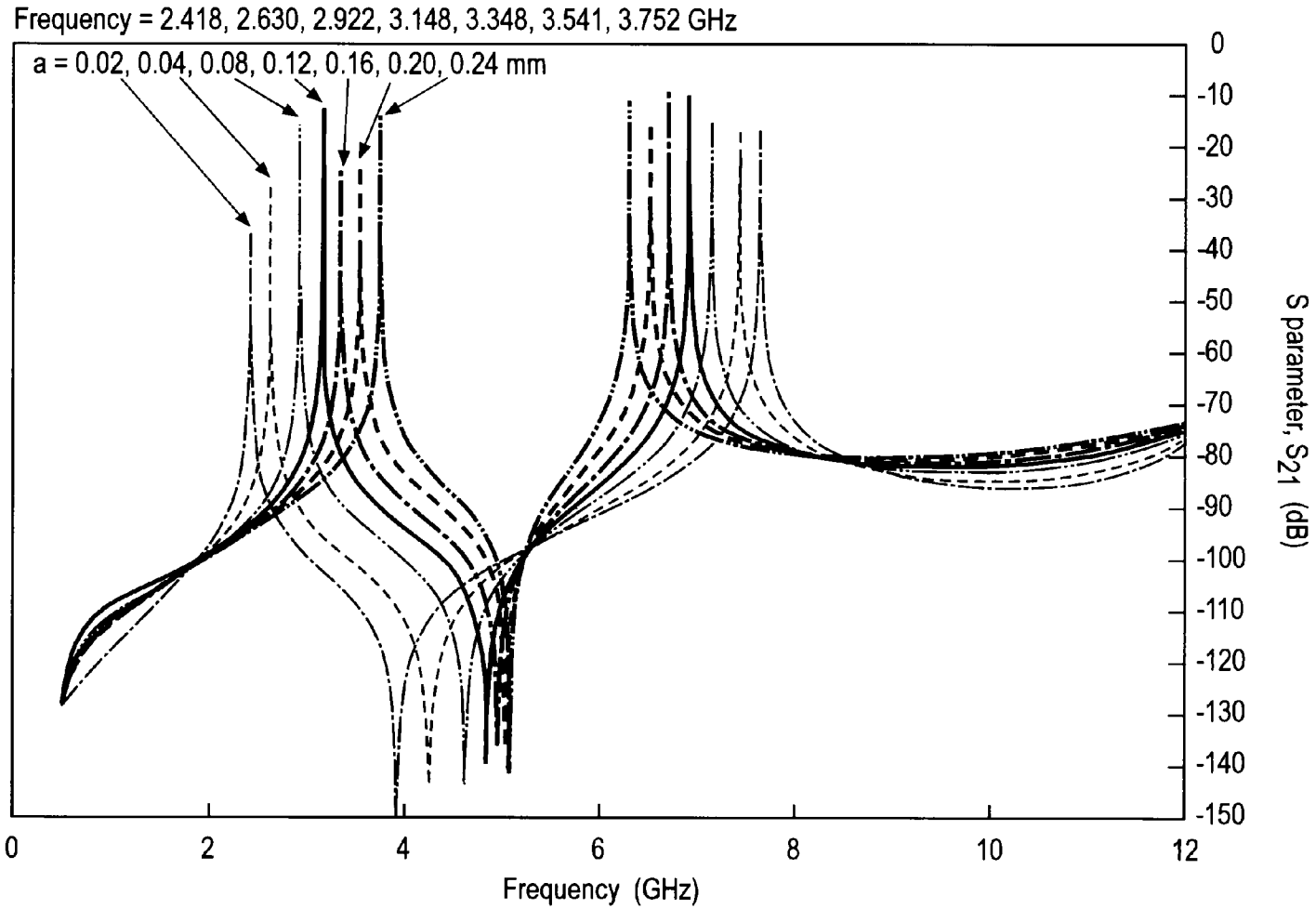
FIG. 3 is a graph showing frequency characteristics of the quarter-wavelength coplanar waveguide resonators used for the electromagnetic simulations.

FIG. 3 is a graph showing that the resonance frequency of the center conductor 101 is split in each case above by using an electromagnetic simulation result showing a relationship between the frequency and the $S_{21}$ parameter (in decibel (dB)) which is the transmission coefficient. In the electromagnetic simulation, the physical length of the center conductor 101 is 6.50 mm, the width of the center conductor 101 is 0.22 mm, and the distance between the peripheral edges 103*a* of the ground conductor 103 that are parallel to the center conductor 101 is 1.20 mm. In addition, the relative permittivity of the dielectric substrate 105 is 9.68, and the thickness of the dielectric substrate 105 is 0.5 mm (these values are used also in the other electromagnetic simulations described later). The width "a" of each gap section 107*a* and the width "b" of each gap section 107*b*, which is the clearance (no-conductor regions) between each first collateral line conductor 104*a* and the corresponding peripheral edge 103*a* of the ground conductor 103, are as shown in the respective drawings. If the two base stubs 104 are not provided, the quarter-wavelength coplanar waveguide resonator has the same configuration as conventional quarter-wavelength coplanar waveguide resonators and resonates at about 5 GHz.

As is apparent from FIG. 3, regardless of the value of the width "a" of the gap section 107*a*, the resonance frequency $f_1$ (about 5 GHz in this simulation) of the center conductor 101 is split, and the center conductor 101 resonates at a frequency $f_2$ (about 2.4 GHz to 3.8 GHz in this simulation) lower than the frequency $f_1$ when the first collateral line conductor 104*a* is disposed close to the center line conductor 101*b*. In addition, it can be seen that the smaller the width of the gap section 107*a*, the lower the frequency $f_2$ at which the center conductor 101 resonates becomes.

This means that, whereas conventional coplanar waveguide resonators having a resonance frequency $f_2$ have to have a center conductor designed and fabricated to have a physical length corresponding to an electrical length equivalent to a quarter wavelength at the resonance frequency $f_2$, the center conductor 101 of the coplanar waveguide resonator having a resonance frequency $f_2$ can be designed and fabricated to have a physical length corresponding an electrical length equivalent to a quarter wavelength at the frequency $f_1$ by the first collateral line conductor 104*a* disposed close to the center line conductor 101*b* of the center conductor 101. Supposing that the wavelength at the time when the frequency is $f_i$ (i=1, 2) is denoted by $\lambda_i$, $\lambda_1<\lambda_2$ if $f_1<f_2$. Therefore, the total length of the quarter-wavelength coplanar waveguide resonator can be reduced.

Since the quarter-wavelength coplanar waveguide resonator 100*a* has the same configuration as conventional quarter-wavelength coplanar waveguide resonators except that the base stubs 104 are formed between the gap sections between the center line conductor and the peripheral edges of the ground conductor, the reduction in total length is directly linked to the reduction of the footprint of the coplanar waveguide resonator on the dielectric substrate. Therefore, the quarter-wavelength coplanar waveguide resonator is miniaturized compared with conventional quarter-wavelength coplanar waveguide resonators.

Whereas the present invention takes advantages of the physical phenomenon that the resonance frequency $f_1$ of the center conductor 101 is split by providing the base stubs 104 and the coplanar waveguide resonator resonates at a frequency $f_2$ lower than the resonance frequency $f_1$, the number of resonance frequencies occurring as a result of the split of the resonance frequency $f_1$ is not necessarily essential to the present invention. Since it will suffice to show that the resonance frequency $f_1$ of the center conductor is split, and the coplanar waveguide resonator resonates at a frequency $f_2$ lower than the resonance frequency $f_1$, only a certain band (from 0 to about 12 GHz) including the resonance frequency $f_1$ is shown in the graphs (FIGS. 3, 10 and 14B to 21B) showing relationships between the $S_{21}$ parameter and the frequency. Therefore, it is to be noted that there may be a further resonance frequency occurring as a result of split of the resonance frequency $f_1$ in a frequency band higher than 12 GHz, not shown in these graphs.

Figure 4:
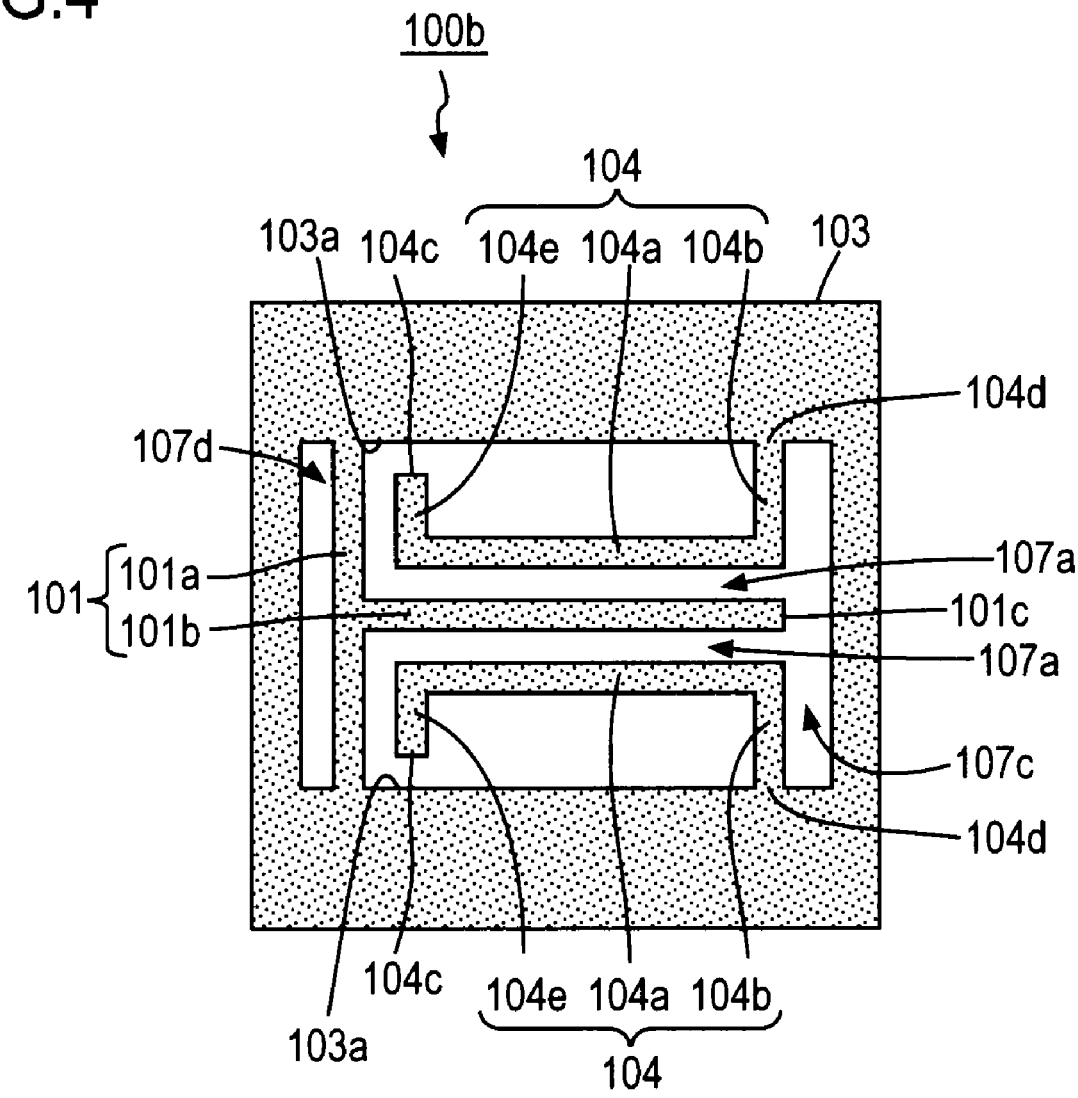
FIG. 4 is a plan view of a quarter-wavelength coplanar waveguide resonator (a variation) according to the embodiment of the present invention.

FIG. 4 shows a quarter-wavelength coplanar waveguide resonator 100*b*, which is a variation of the quarter-wavelength coplanar waveguide resonator 100*a*.

The quarter-wavelength coplanar waveguide resonator 100*b* differs from the quarter-wavelength coplanar waveguide resonator 100*a* in that each base stub 104 has a line conductor 104*e* formed in parallel with the short-circuited line conductor 101*a*. In the following, the line conductor 104*e* will be referred to as second collateral line conductor. In other words, the second collateral line conductor 104*e* is a line conductor formed by bending the open-circuited end 104*c* of the quarter-wavelength coplanar waveguide resonator 100*a* so that the open-circuited end 104*c* faces the peripheral edge 103*a*, and extending it straight toward the peripheral edge 103*a* of the ground conductor 103 parallel to the center line conductor 101*b*.

Figure 5:
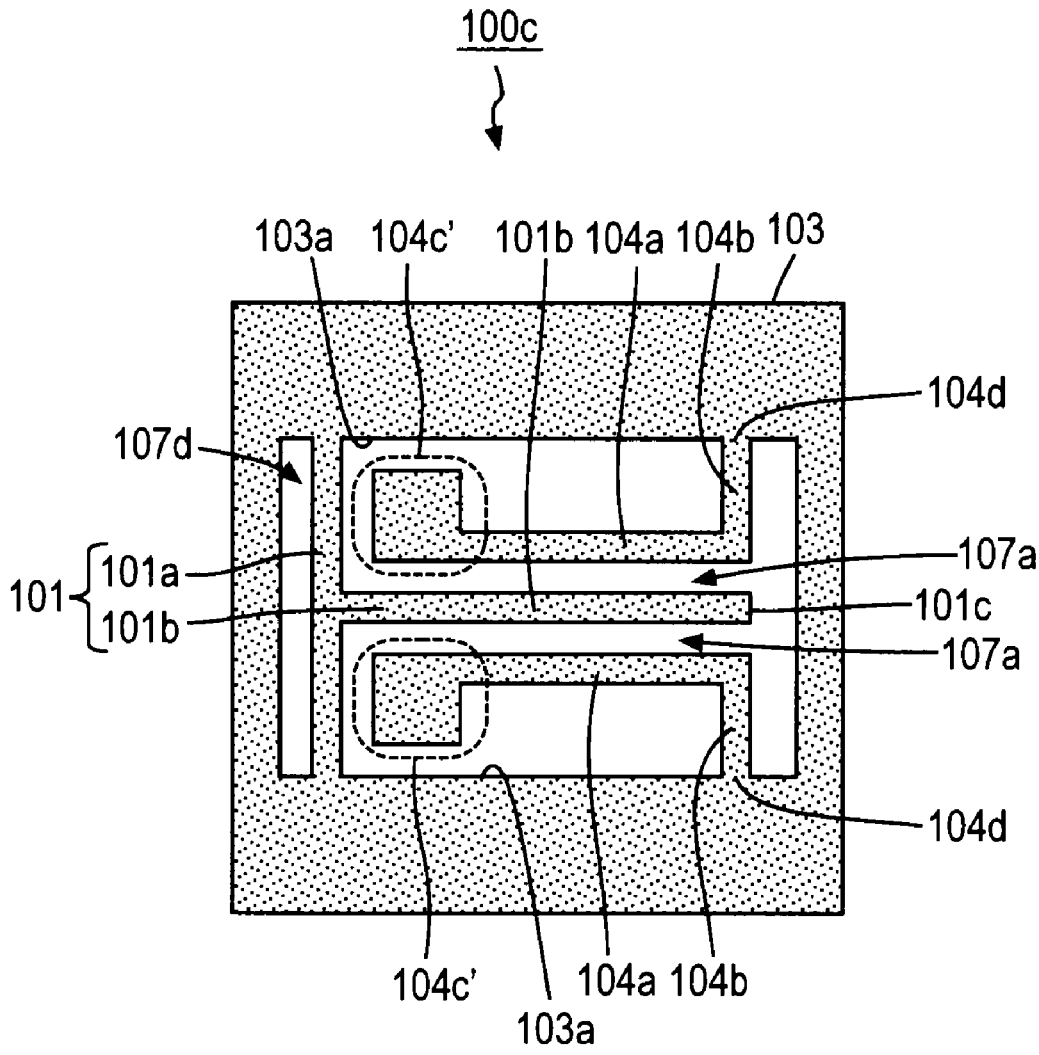
FIG. 5 is a plan view of a quarter-wavelength coplanar waveguide resonator (a variation) according to the embodiment of the present invention.

FIG. 5 shows a quarter-wavelength coplanar waveguide resonator 100*c*, which is a variation of the quarter-wavelength coplanar waveguide resonator 100*a*.

The quarter-wavelength coplanar waveguide resonator 100*c* differs from the quarter-wavelength coplanar waveguide resonator 100*b* in that each base stub 104 has a stepped impedance structure. Specifically, as shown in FIG. 5, a part neighborhood of each open-circuited end 104*c* of each base stub 104 in the quarter-wavelength coplanar waveguide resonator 100*b* at the open-circuited end 104*c* is expanded to form a rectangular part 104*c'*.

Figure 6:
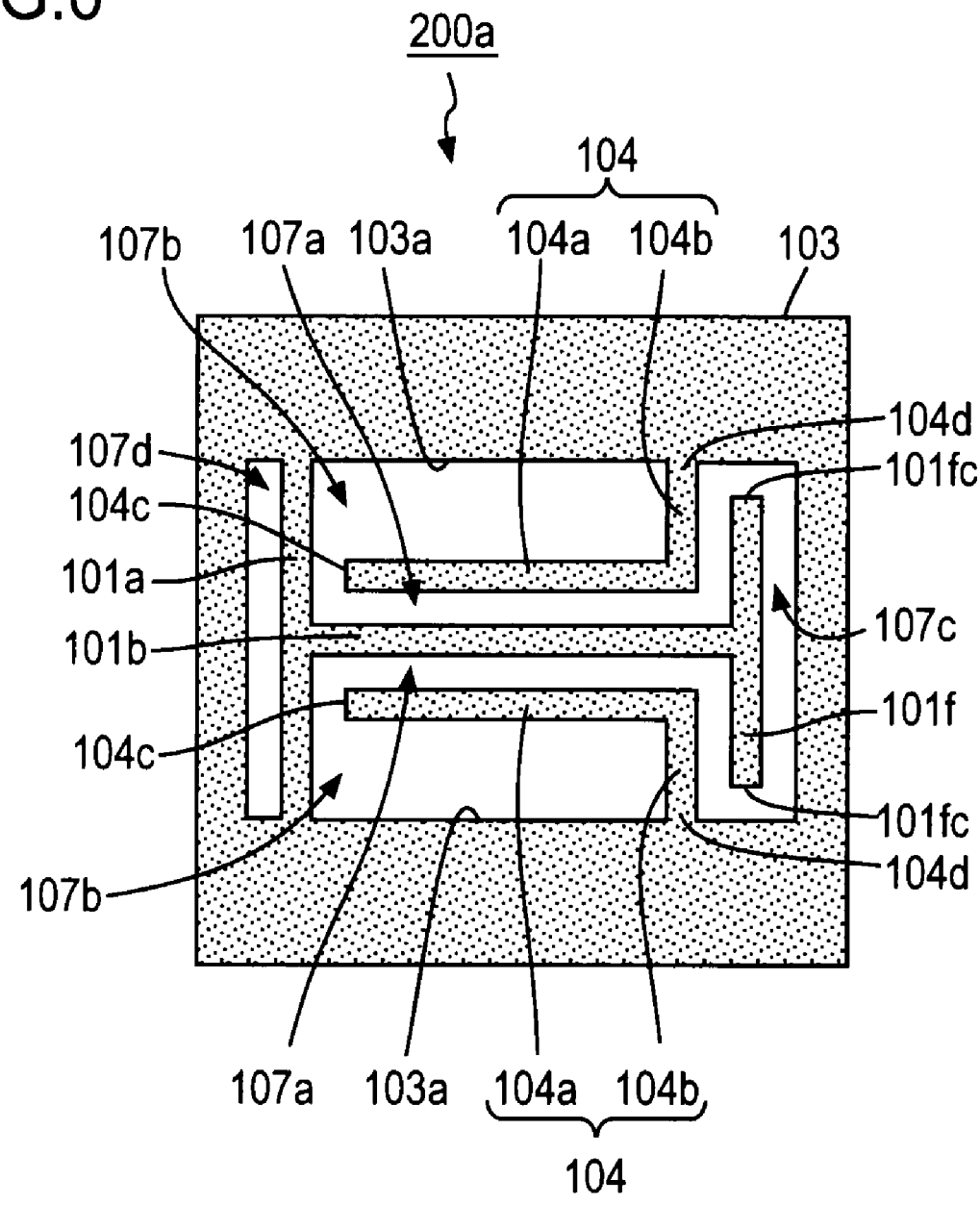
FIG. 6 is a plan view of a quarter-wavelength coplanar waveguide resonator according to another embodiment of the present invention.

Next, a coplanar waveguide resonator according to another embodiment of the present invention will now be described. In this embodiment, the description will be given with respect to a quarter-wavelength coplanar waveguide resonator as in the above description. A quarter-wavelength coplanar waveguide resonator 200*a* shown in FIG. 6 is a variation of the quarter-wavelength coplanar waveguide resonator 100*a* shown in FIG. 1 and differs from the quarter-wavelength coplanar waveguide resonator 100*a* in that the open-circuited end 101*c* is branched in two directions to make two open-circuited ends. In other words, the quarter-wavelength coplanar waveguide resonator 200*a* has the same configuration as the quarter-wavelength coplanar waveguide resonator 100*a* except that the open-circuited end 101*c* of the center conductor 101 is extended into the gap section 107*c*, and a line conductor 101*f* having open-circuited ends and extending perpendicularly to the center line conductor 101*b* is integrally connected to the open-circuited end 101*c* at the center thereof. Open-circuited ends 101*fc* of the line conductor 101*f*, which is a part of the center conductor 101, face the respective peripheral edges 103*a* of the ground conductor 103 that are parallel to the center line conductor 101*b* of the center conductor 101. The line conductors 104*b* of the base stubs 104 and the line conductor 101*f* are disposed with each other's parts having a uniform distance. The length of the line conductor 101*f* is determined so that the center conductor 101 has a desired resonance frequency in a correlation with the lengths of the short-circuited line conductor 101*a* and the center line conductor 101*b*.

Figure 7:
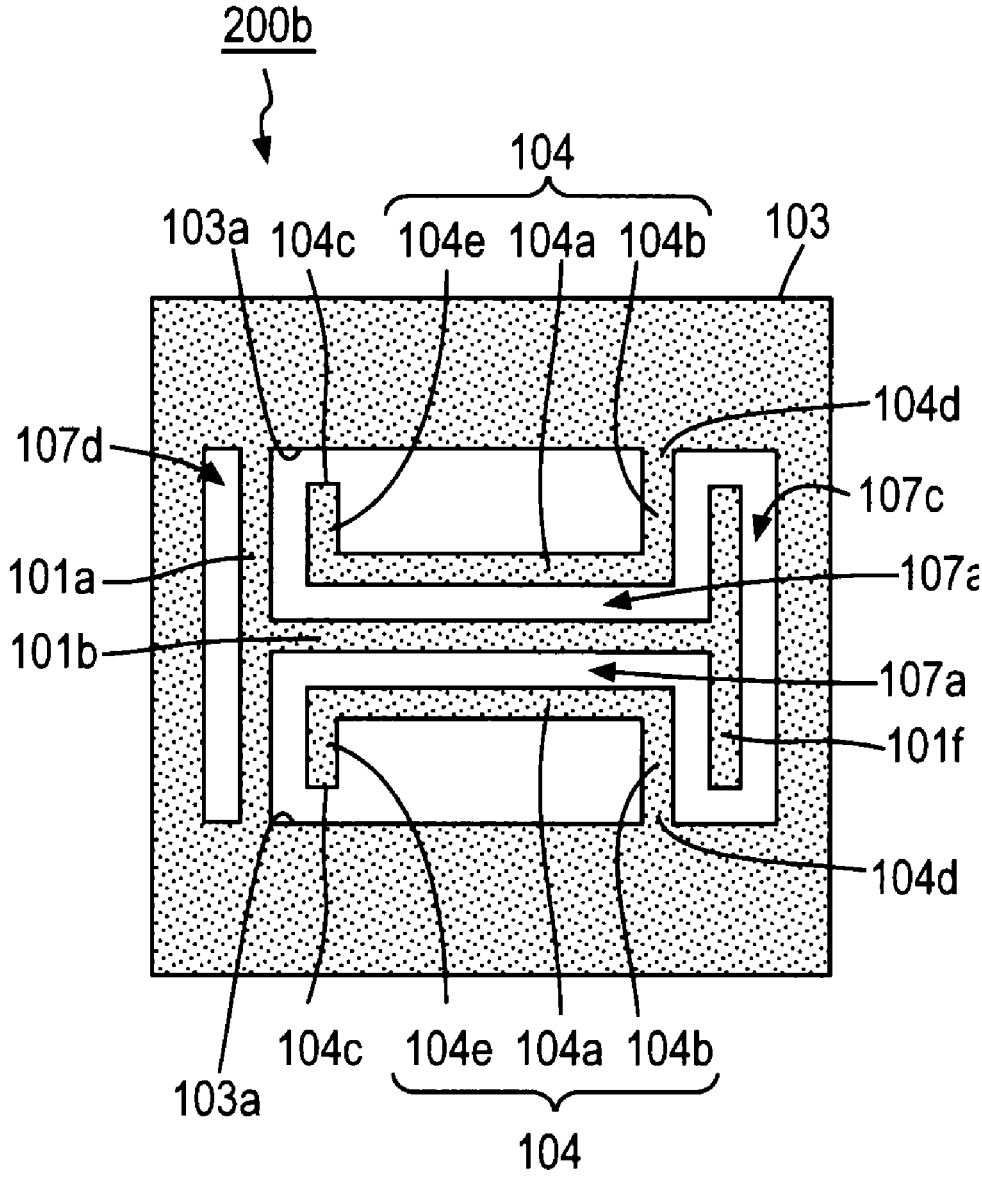
FIG. 7 is a plan view of a quarter-wavelength coplanar waveguide resonator (a variation) according to the another embodiment of the present invention.

FIG. 7 shows a quarter-wavelength coplanar waveguide resonator 200*b*, which is a variation of the quarter-wavelength coplanar waveguide resonator 200*a*.

The quarter-wavelength coplanar waveguide resonator 200*b* can also be considered as a variation of the quarter-wavelength coplanar waveguide resonator 100*b* shown in FIG. 4. The quarter-wavelength coplanar waveguide resonator 200*b* differs from the quarter-wavelength coplanar waveguide resonator 100*b* in that the open-circuited end 101*c* is branched in two directions to make two open-circuited ends as with the quarter-wavelength coplanar waveguide resonator 200*a*.

Figure 8:
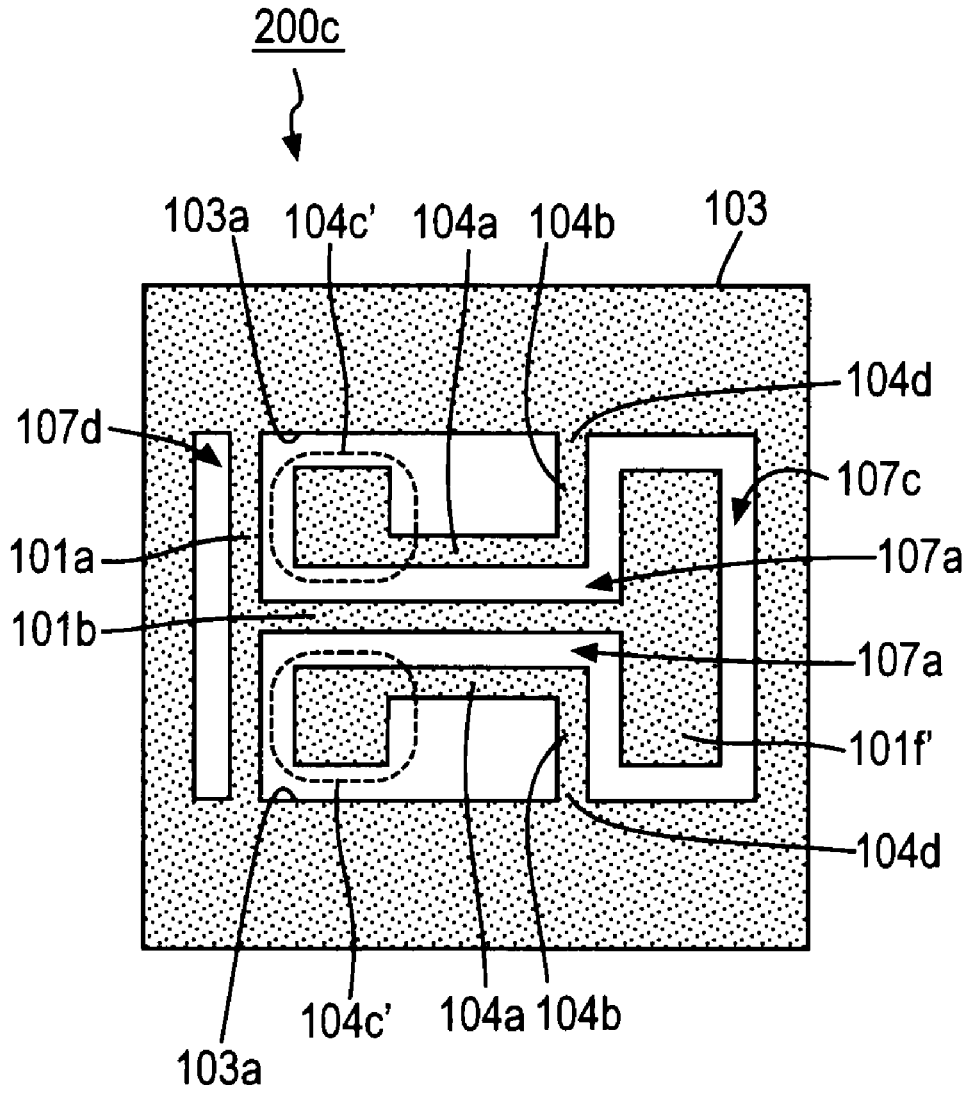
FIG. 8 is a plan view of a quarter-wavelength coplanar waveguide resonator (a variation) according to the another embodiment of the present invention.
Figure 9A:
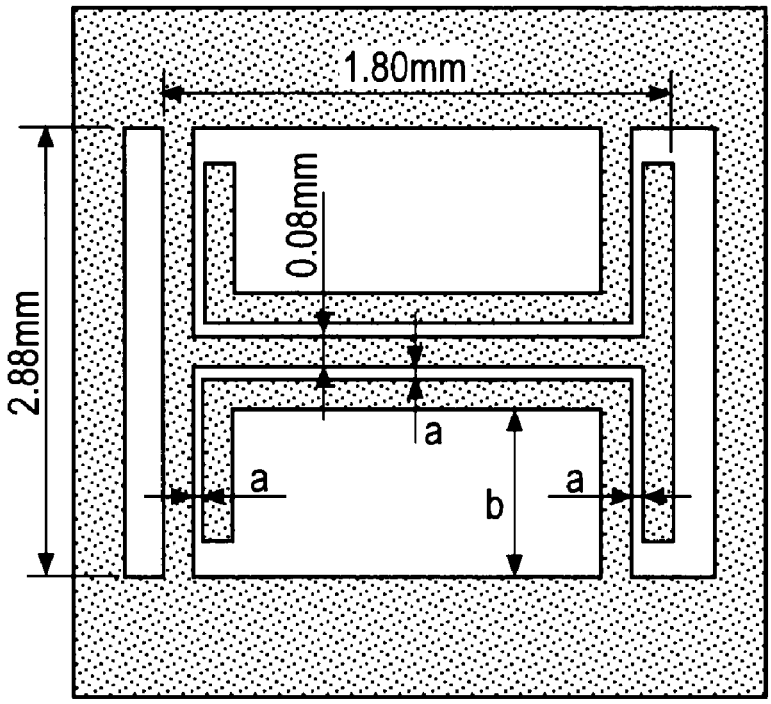
FIG. 9A is a plan view of a quarter-wavelength coplanar waveguide resonator used for an electromagnetic simulation.
Figure 9B:
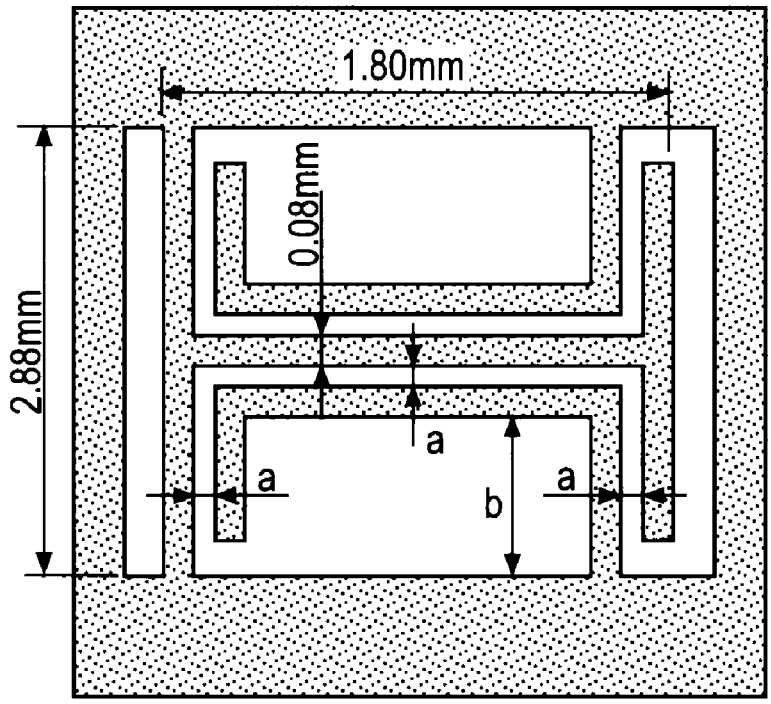
FIG. 9B is a plan view of a quarter-wavelength coplanar waveguide resonator used for an electromagnetic simulation.
Figure 9C:
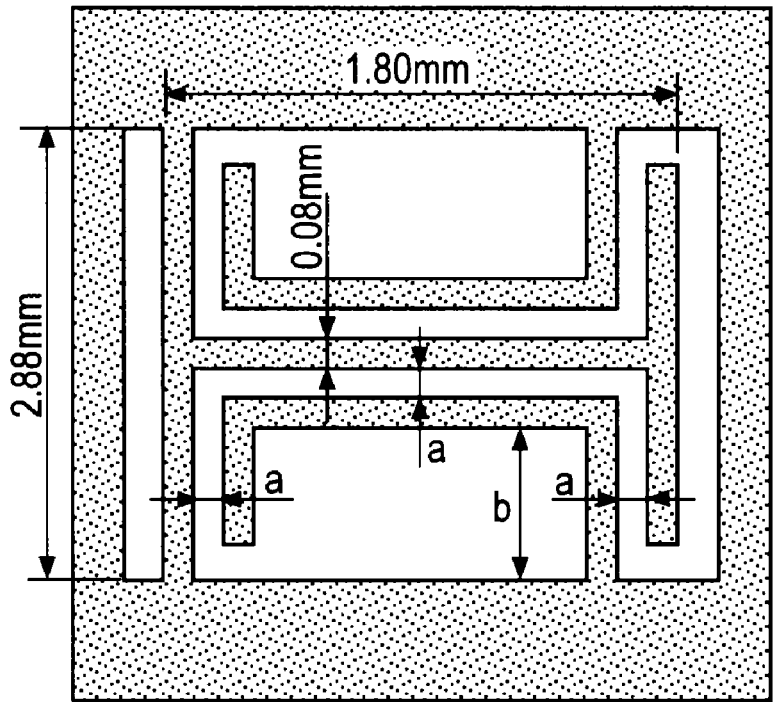
FIG. 9C is a plan view of a quarter-wavelength coplanar waveguide resonator used for an electromagnetic simulation.
Figure 9D:
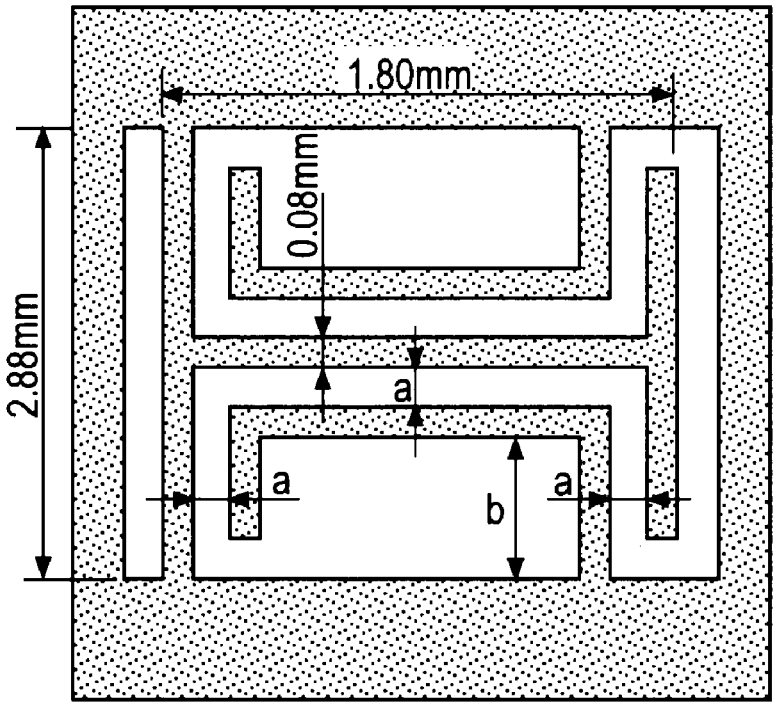
FIG. 9D is a plan view of a quarter-wavelength coplanar waveguide resonator used for an electromagnetic simulation.
Figure 9E:
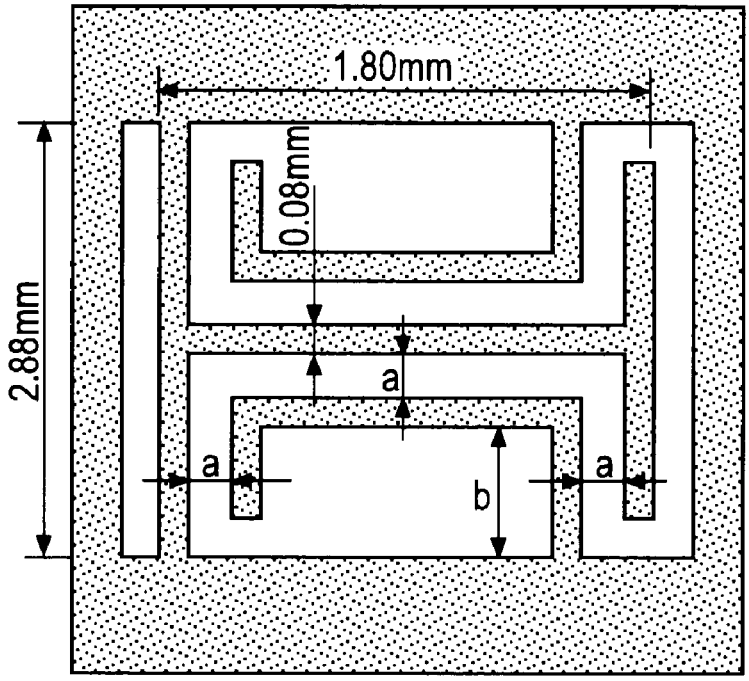
FIG. 9E is a plan view of a quarter-wavelength coplanar waveguide resonator used for an electromagnetic simulation.
Figure 9F:
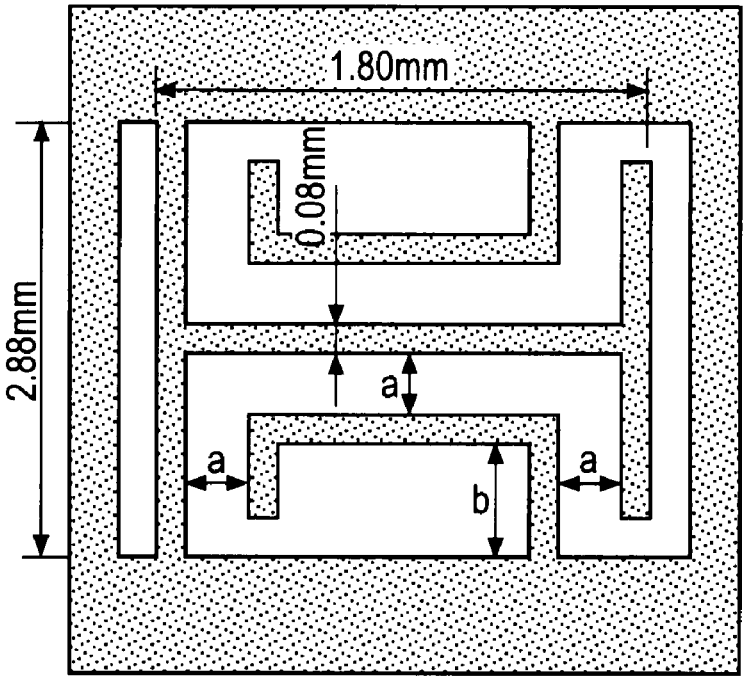
FIG. 9F is a plan view of a quarter-wavelength coplanar waveguide resonator used for an electromagnetic simulation.
Figure 9G:
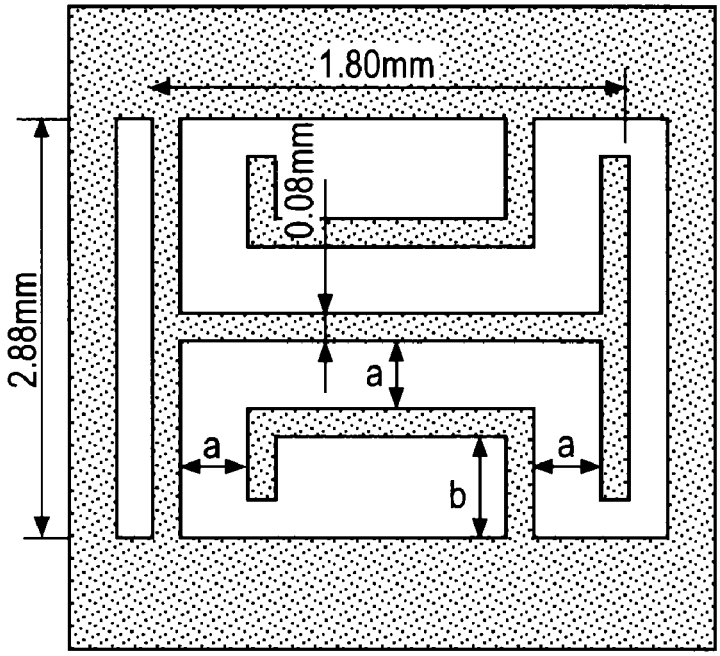
FIG. 9G is a plan view of a quarter-wavelength coplanar waveguide resonator used for an electromagnetic simulation.
Figure 9H:
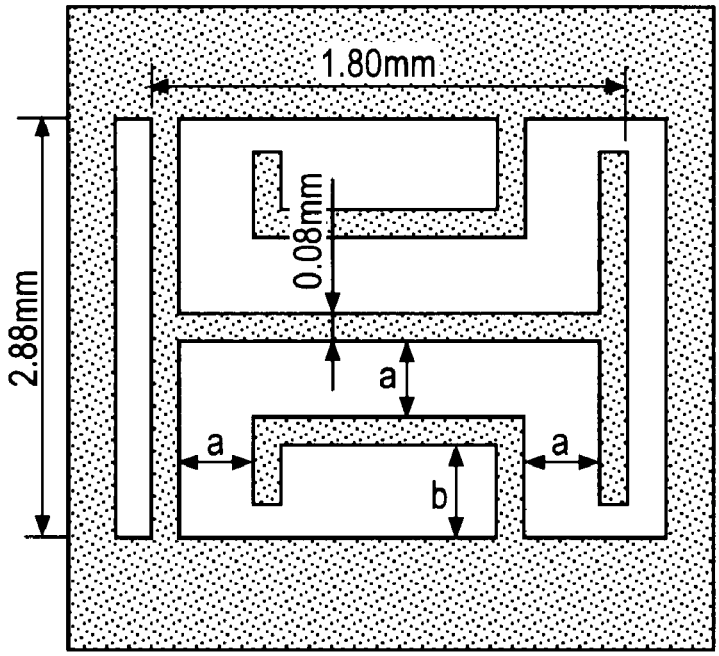
FIG. 9H is a plan view of a quarter-wavelength coplanar waveguide resonator used for an electromagnetic simulation.
Figure 9I:
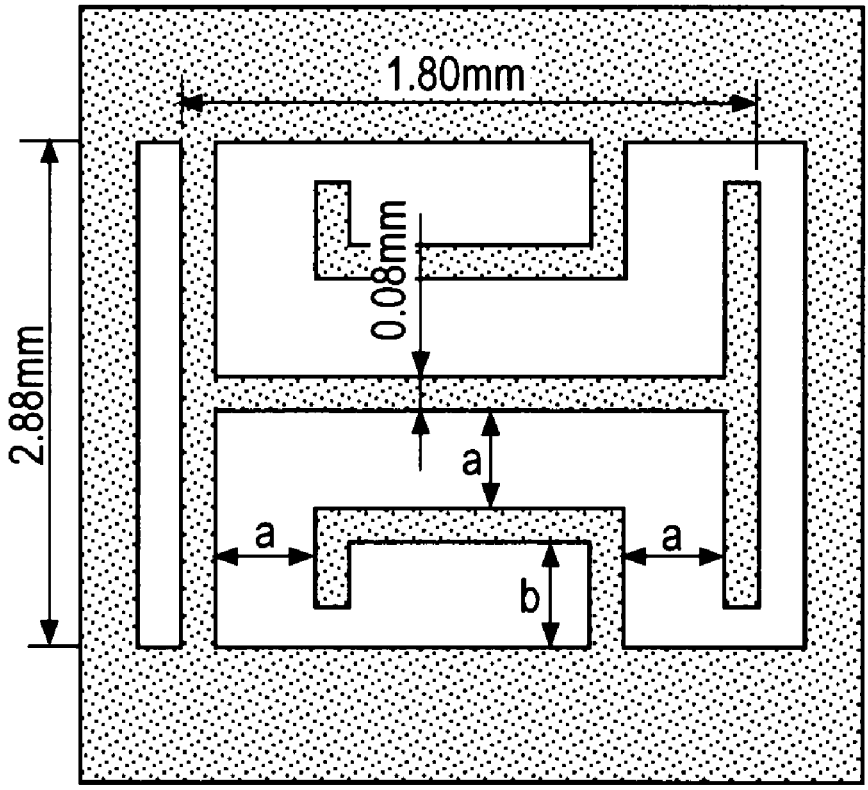
FIG. 9I is a plan view of a quarter-wavelength coplanar waveguide resonator used for an electromagnetic simulation.

FIG. 8 shows a quarter-wavelength coplanar waveguide resonator 200*c*, which is a variation of the quarter-wavelength coplanar waveguide resonator 200*a*.

The quarter-wavelength coplanar waveguide resonator 200*c* can also be considered as a variation of the quarter-wavelength coplanar waveguide resonator 100*c* shown in FIG. 5. The quarter-wavelength coplanar waveguide resonator 200*c* differs from the quarter-wavelength coplanar waveguide resonator 100*c* in that the open-circuited end 101*c* is branched in two directions to make two open-circuited ends as with the quarter-wavelength coplanar waveguide resonator 200*a*. In the quarter-wavelength coplanar waveguide resonator 200*c*, the center conductor 101 also has a stepped impedance structure; specifically the line conductor 101*f* is expanded to form a rectangular part 101*f'*.

In the quarter-wavelength coplanar waveguide resonator 200*b* shown in FIG. 7 (although not limited to this example), since the first collateral line conductors 104*a* are disposed close to the center line conductor 101*b* of the center conductor 101, the second collateral line conductors 104*e* are disposed close to the short-circuited line conductor 101*a* of the center conductor 101, and the line conductors 104*b* of the base stubs 104 are disposed close to the line conductor 101*f* of the center conductor 101, the resonance frequency $f_1$ of the center conductor 101 can be split, and the center conductor 101 can be made to resonate at the frequency $f_2$ lower than the frequency $f_1$.

This will be described with reference to FIGS. 9A to 9I and 10.

FIGS. 9A to 9I show various configurations of the quarter-wavelength coplanar waveguide resonator 200*b*. In each configuration, the width of the gap section that is the clearance (no-conductor region) between the center line conductor 101*b* and each first collateral line conductor 104*a*, the width of the gap section that is the clearance (no-conductor region) between the short-circuited line conductor 101*a* and each second collateral line conductor 104*e*, and the width of the gap section that is the clearance (no-conductor region) between the line conductor 101*f* and the line conductor 104*b* of each base stub 104 (in the following, these three widths will be generically referred to as U-shaped gap width) are equal to each other. The configurations of the quarter-wavelength coplanar waveguide resonator 200*b* shown in FIGS. 9A to 9I are the same except for the U-shaped gap width.

Figure 10:
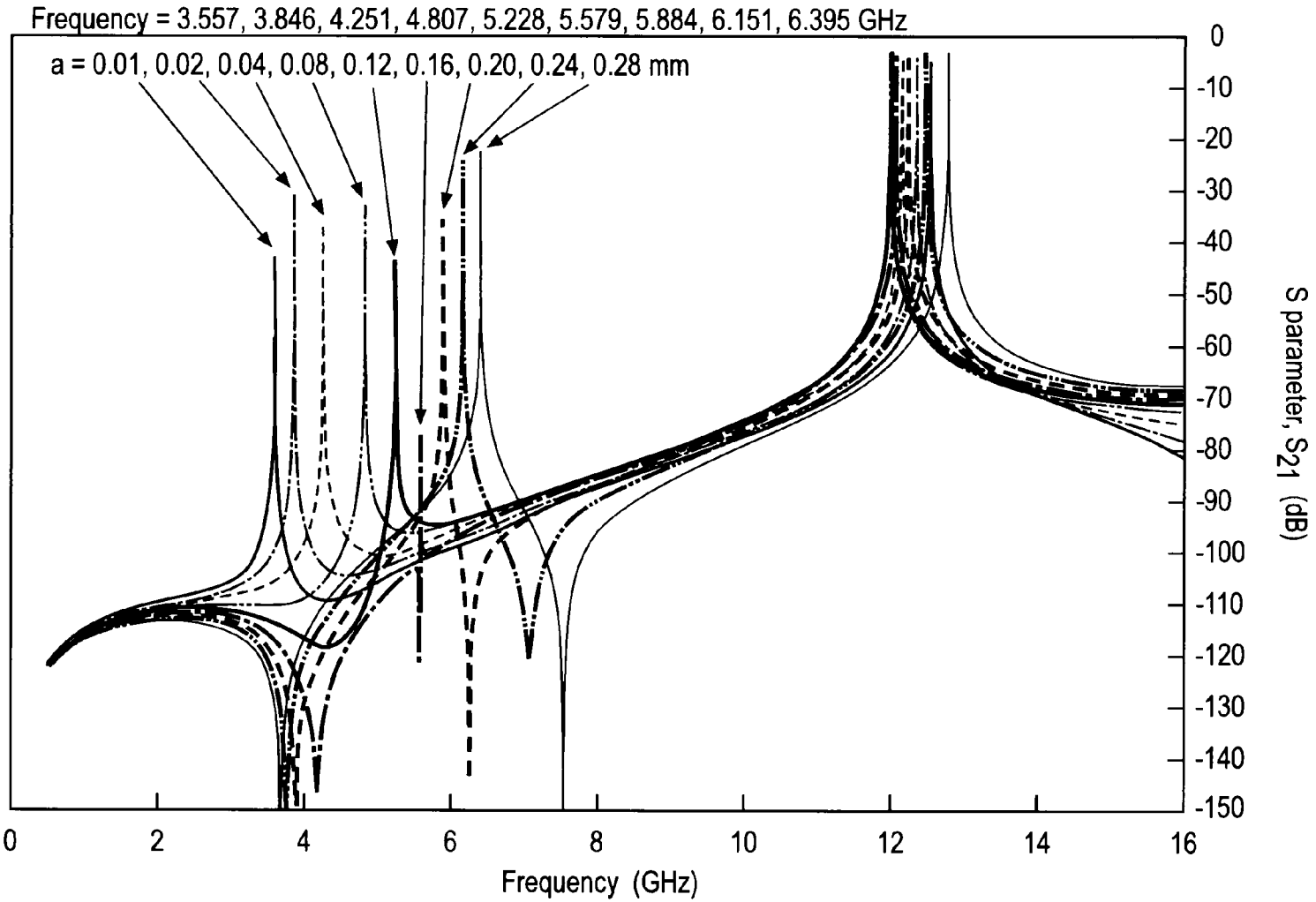
FIG. 10 is a graph showing frequency characteristics of the quarter-wavelength coplanar waveguide resonators used for the electromagnetic simulations.

FIG. 10 is a graph showing that the resonance frequency of the center conductor 101 is split in the configurations of the quarter-wavelength coplanar waveguide resonator 200*b* shown in FIGS. 9A to 9I by using an electromagnetic simulation result showing a relationship between the frequency and the $S_{21}$ parameter (in decibel (dB)) which is the transmission coefficient. In the electromagnetic simulation, the width of the center conductor 101 is 0.08 mm, the distance between the outer sides of the short-circuited line conductor 101*a* and the line conductor 101*f* is 1.80 mm, and the distance between the peripheral edges 103*a* of the ground conductor 103 that are parallel to the center line conductor 101*b* is 2.88 mm. The value "a" of the U-shaped gap width and the width "b" of the gap section 107*b*, which is the clearance (no-conductor region) between each first collateral line conductor 104*a* and the peripheral edge 103*a* of the ground conductor 103, are as shown in the respective drawings. If the two base stubs 104 are not provided, the quarter-wavelength coplanar waveguide resonator resonates at 8 GHz.

As is apparent from FIG. 10, regardless of the value of the U-shaped gap width "a", the resonance frequency $f_1$ (about 8 GHz in this simulation) of the center conductor 101 is split, and the center conductor 101 resonates at a frequency $f_2$ (about 3.5 GHz to 6.4 GHz in this simulation) lower than the frequency $f_1$ when the first collateral line conductors 104*a* are disposed close to the center line conductor 101*b*, the second collateral line conductors 104*e* are disposed close to the short-circuited line conductor 101*a*, and the line conductors 104*b* of the base stubs 104 are disposed close to the line conductor 101*f*. In addition, it can be seen that the smaller the U-shaped gap width, the lower the frequency $f_2$ at which the center conductor 101 resonates becomes.

Therefore, as described above, the center conductor for a desired frequency can be designed and fabricated as a line conductor having a physical length corresponding to an electrical length equivalent to a quarter wavelength at a frequency higher than the desired frequency, and since the quarter-wavelength coplanar waveguide resonator has a simple structure in which the base stubs 104 are additionally provided in the gap sections between the center line conductor 101*b* and the ground conductor 103, the quarter-wavelength coplanar waveguide resonator is miniaturized compared with conventional quarter-wavelength coplanar waveguide resonators.

Figure 11:
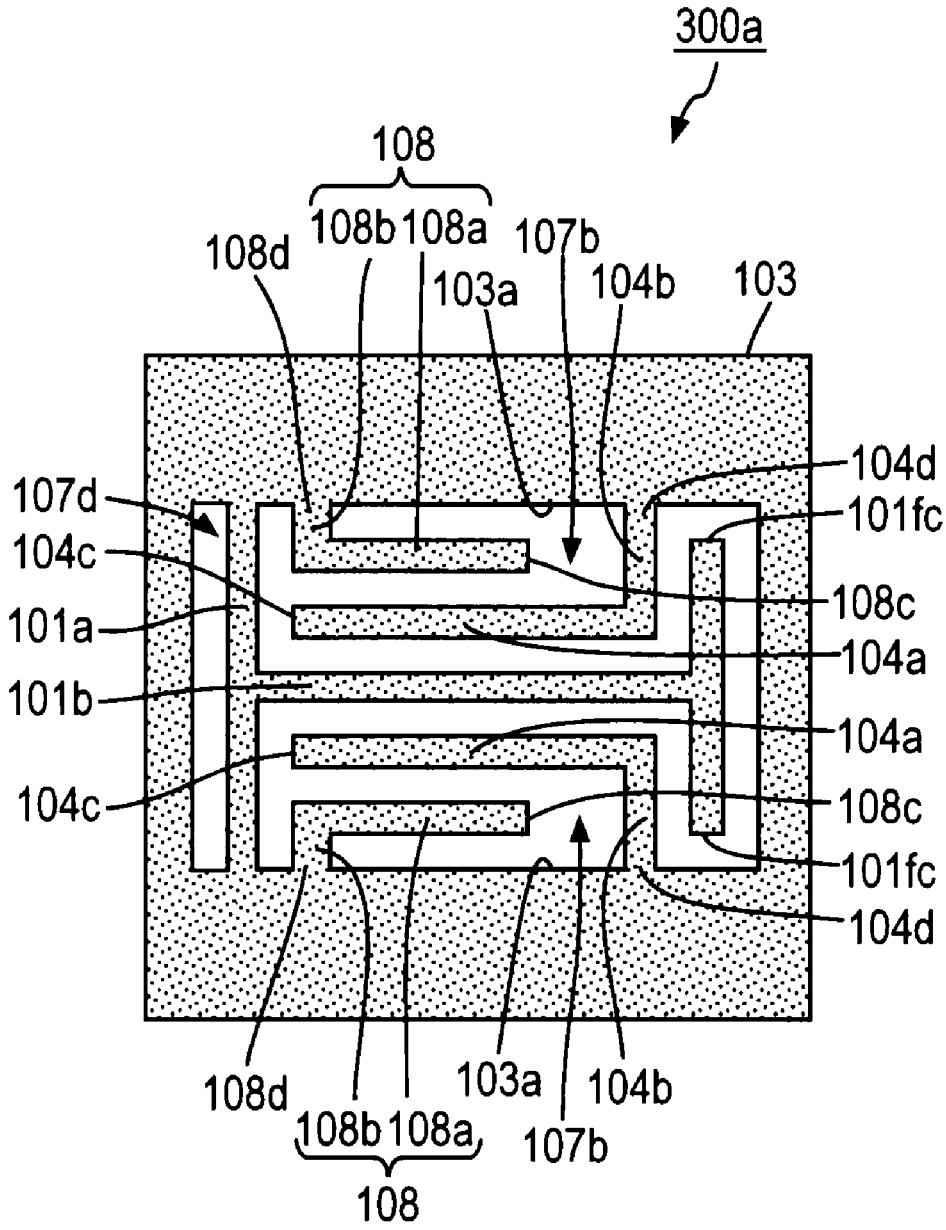
FIG. 11 is a plan view of a quarter-wavelength coplanar waveguide resonator according to another embodiment of the present invention.

Next, a coplanar waveguide resonator according to another embodiment of the present invention will be described. In this embodiment, the description will be given with respect to a quarter-wavelength coplanar waveguide resonator as in the embodiments described above. A quarter-wavelength coplanar waveguide resonator 300*a* shown in FIG. 11 is a variation of the quarter-wavelength coplanar waveguide resonator 200*a* shown in FIG. 6 and differs from the quarter-wavelength coplanar waveguide resonator 200*a* in that one or more line conductors are formed in the gap sections 107*b*, or the clearances (no-conductor regions) between the peripheral edges 103*a* of the ground conductor 103 and the first collateral line conductors 104*a*, in an interdigital and nested configuration. The newly formed line conductor has a shape approximately similar to that of the base stub 104 and has an electrical length shorter than that of the base stub 104 at the resonance frequency of the center conductor 101, that is, a physical length from the short-circuited end to open-circuited end which is shorter than that of the base stub 104. Therefore, in the following, this line conductor will be referred to as downsized stub. The width of the downsized stub may be equal to or different from that of the base stub 104. The quarter-wavelength coplanar waveguide resonators shown in FIGS. 11 to 13 have one newly formed downsized stub in each gap section 107*b*.

Each downsized stub 108 shown in FIG. 11 is a line conductor having an L-shape approximately similar to that of the base stub 104, where the L-shape of each downsized stub 108 is inversion of the L-shape of the base stub 104. The downsized stub 108 is composed of a straight line conductor 108*a* that is disposed to have a uniform distance from the line conductor 104*a* with a gap section interposed therebetween and a line conductor 108*b* that connects one end of the line conductor 108*a* (the end opposite to an open-circuited end 108*c* of the downsized stub 108) to the ground conductor 103.

The downsized stub 108 is connected to the ground conductor 103 at a root part 108*d* thereof. The root part 108*d* is located on the side of the open-circuited end 104*c* of the base stub 104 and connected to a peripheral edge 103*a* of the ground conductor 103 that is parallel to the center line conductor 101*b*. The two downsized stubs 108 are disposed symmetrically in the gap sections 107*b* on the opposite sides of the center line conductor 101*b* of the center conductor 101. In the quarter-wavelength coplanar waveguide resonator 300*a* shown in FIG. 11, the open-circuited ends 104*c* of the base stubs 104 and the root parts 108*d* of the two downsized stubs 108 are located substantially in line with each other. However, such a positional relationship is not essential to the present invention. The open-circuited ends 108*c* of the two downsized stubs 108 face the line conductors 104*b* of the base stubs 104.

In other words, the first collateral line conductors 104*a* of the base stubs 104 and the line conductors 108*a* of the downsized stubs 108 extend in the opposite directions in an interdigital configuration. Furthermore, the center line conductor 101*b* of the center conductor 101, the first collateral line conductors 104*a* of the base stubs 104 and the line conductors 108*a* of the downsized stubs 108 extend in the opposite directions in an interdigital configuration. In addition, since the downsized stubs 108 are shorter than the base stubs 104 and are disposed in the gap sections 107*b*, the base stubs 104 and the downsized stubs 108 are positioned in a nested configuration.

In this embodiment, one downsized stub 108 is formed in each gap section 107*b*. However, two or more downsized stubs 108 can be formed in each gap section 107*b*. For example, in the case where two downsized stubs are formed in each gap section 107*b*, in a gap section that is the clearance (no-conductor region) between the line conductor 108*a* of the downsized stub 108 and the peripheral edge 103*a* of the ground conductor 103, a second downsized stub shorter than the downsized stub 108 can be formed in a positional relationship with respect to the downsized stub 108 that is similar to the positional relationship between the base stub 104 and the downsized stub 108. In the same manner, one or more downsized stubs are provided in an interdigital and nested configuration (see FIGS. 17A and 18A).

Figure 12:
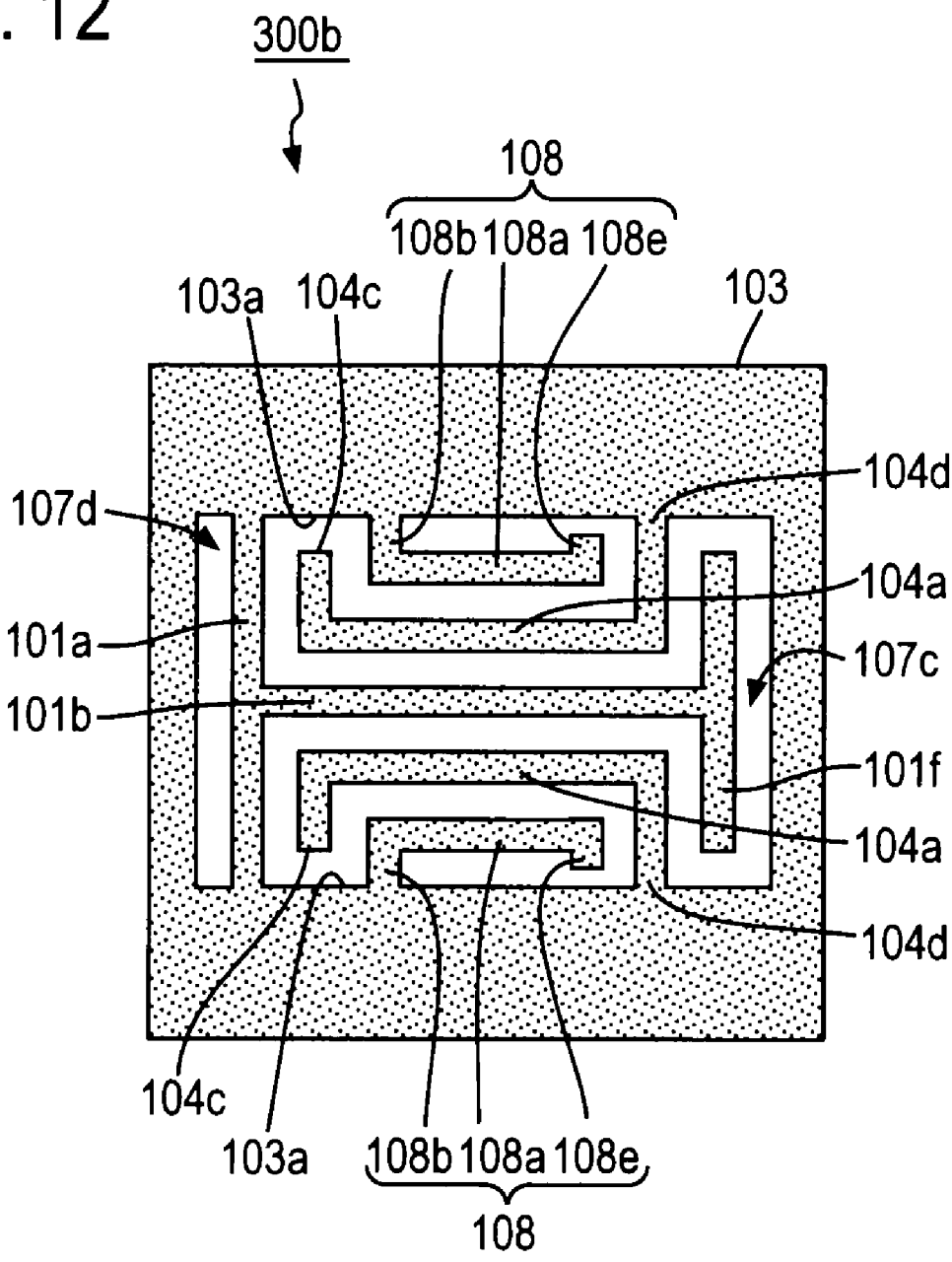
FIG. 12 is a plan view of a quarter-wavelength coplanar waveguide resonator (a variation) according to the another embodiment of the present invention.

FIG. 12 shows a quarter-wavelength coplanar waveguide resonator 300*b*, which is a variation of the quarter-wavelength coplanar waveguide resonator 300*a*.

The quarter-wavelength coplanar waveguide resonator 300*b* can also be considered as a variation of the quarter-wavelength coplanar waveguide resonator 200*b* shown in FIG. 7. The quarter-wavelength coplanar waveguide resonator 300*b* differs from the quarter-wavelength coplanar waveguide resonator 200*b* in that one or more downsized stubs (one downsized stub in the drawing) are formed in each gap section 107*b* in an interdigital and nested configuration as with the quarter-wavelength coplanar waveguide resonator 300*a*.

Figure 13:
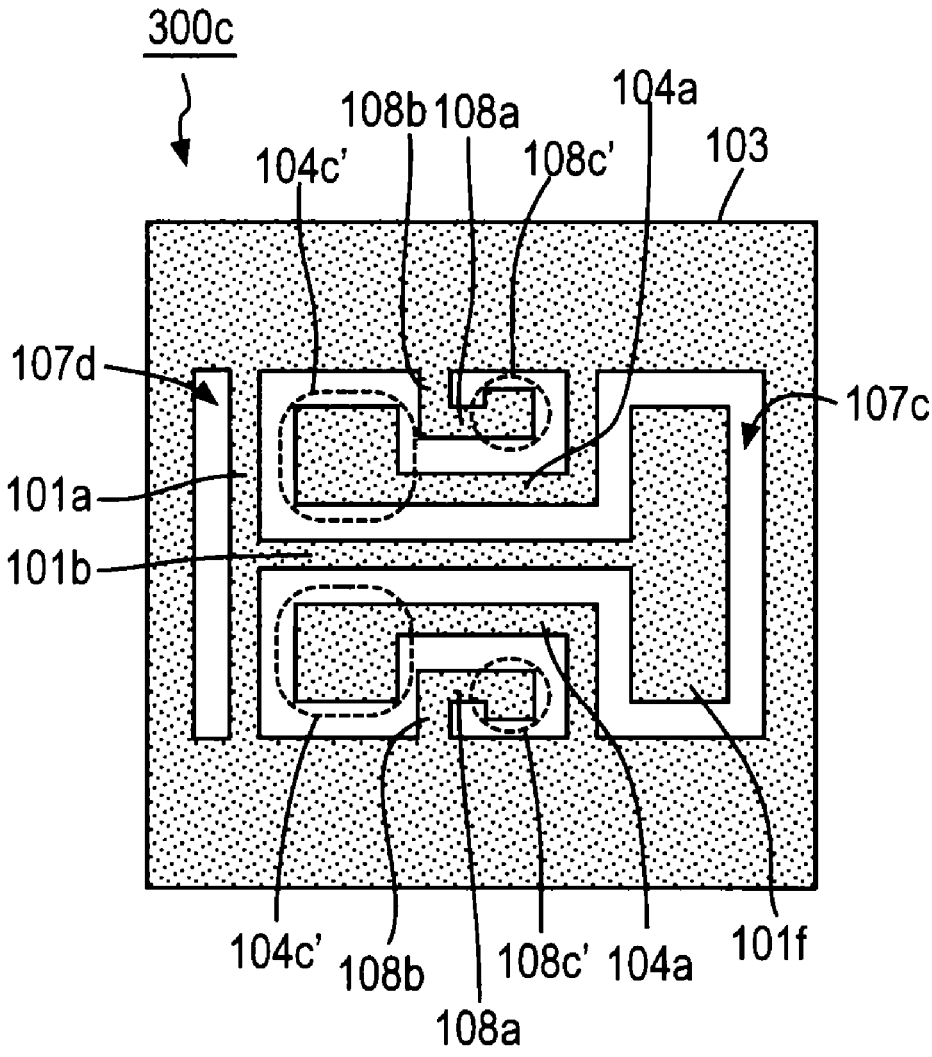
FIG. 13 is a plan view of a quarter-wavelength coplanar waveguide resonator (a variation) according to the another embodiment of the present invention.

FIG. 13 shows a quarter-wavelength coplanar waveguide resonator 300*c*, which is a variation of the quarter-wavelength coplanar waveguide resonator 300*a*.

The quarter-wavelength coplanar waveguide resonator 300*c* can also be considered as a variation of the quarter-wavelength coplanar waveguide resonator 200*c* shown in FIG. 8. The quarter-wavelength coplanar waveguide resonator 300*c* differs from the quarter-wavelength coplanar waveguide resonator 200*c* in that one or more downsized stubs (one downsized stub in the drawing) are formed in each gap section 107*b* in an interdigital and nested configuration as with the quarter-wavelength coplanar waveguide resonator 300*a*. In the quarter-wavelength coplanar waveguide resonator 300*c*, the downsized stubs 108 also have a stepped impedance structure; specifically open-circuited ends 108*c* of the line conductors 108*a* are expanded to form rectangular parts 108*c*'.

Next, further features of the present invention will be described with reference to several exemplary variations.

The quarter-wavelength coplanar waveguide resonator 200*b* shown in FIG. 7 will be taken as an example. FIGS. 14 to 16 show electromagnetic simulation results showing the way that the resonance frequency $f_1$ of the center conductor 101 varies depending on the arrangement of the base stubs 104. Input/output terminals 851 and 852 are provided on the opposite ends of the coplanar waveguide resonator shown (the left and right ends of the coplanar waveguide resonator when the drawing is viewed straight from the front).

Figure 14A:
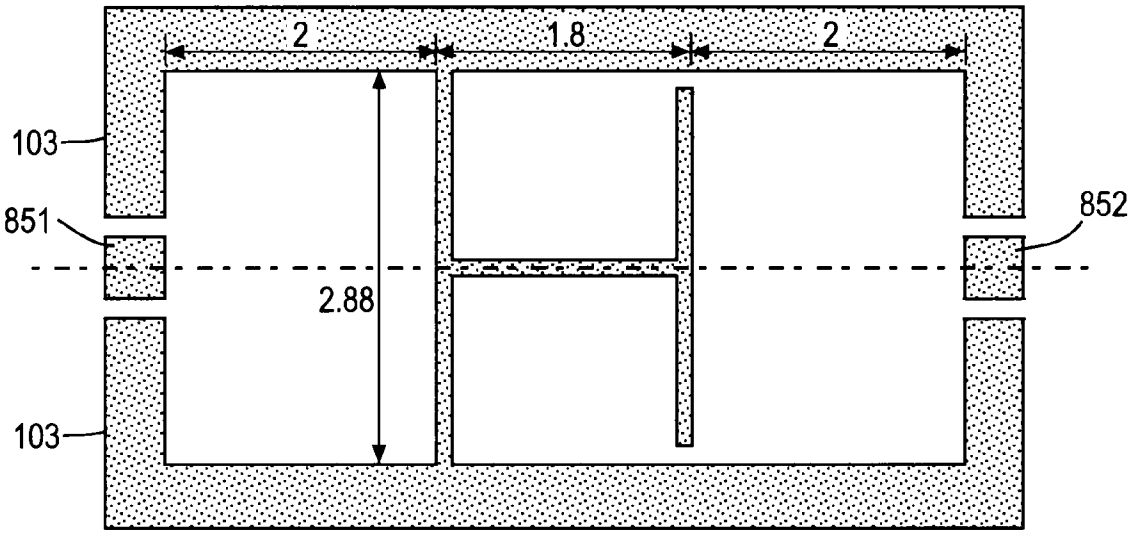
FIG. 14A PRIOR ART
FIG. 14A is a plan view of a conventional quarter-wavelength coplanar waveguide resonator.
Figure 14B:
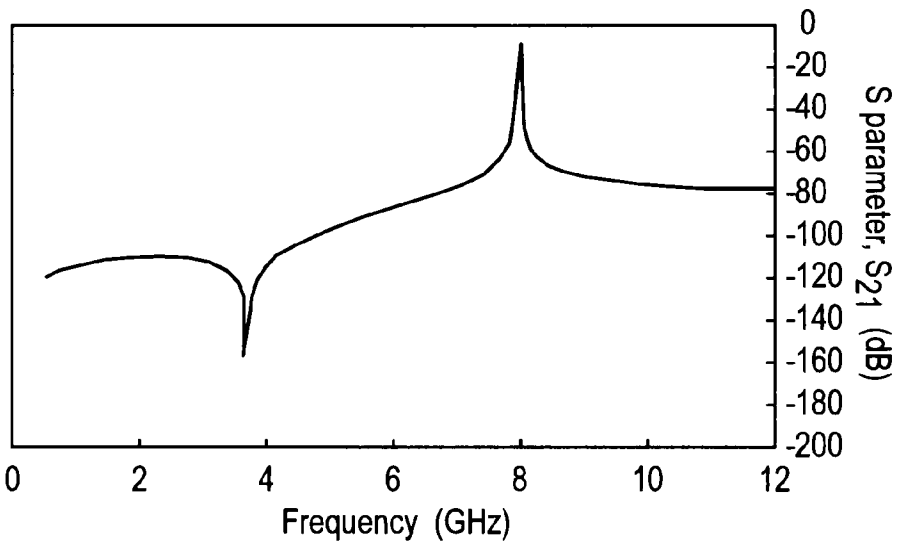
FIG. 14B PRIOR ART
FIG. 14B is a graph showing frequency characteristics of the quarter-wavelength coplanar waveguide resonator shown in FIG. 14A.

FIG. 14A shows a conventional quarter-wavelength coplanar waveguide resonator having no base stub 104. In the electromagnetic simulation, the width of the center conductor 101 is 0.08 mm, the distance between the short-circuited line conductor 101*a* and the line conductor 101*f* is 1.80 mm, and the distance between the peripheral edges 103*a* that are parallel to the center line conductor 101*b* is 2.88 mm. Each width of the gap section 107*d* and the gap section 107*c* in the input/output direction is 2.00 mm. The quarter-wavelength coplanar waveguide resonator is designed so that the center conductor 101 resonates at 8 GHz. FIG. 14B shows a relationship between the $S_{21}$ parameter (in decibel (dB)) and the frequency of the conventional quarter-wavelength coplanar waveguide resonator. As designed, the resonance frequency of the center conductor 101 is 8 GHz. While the resonance frequency is referred to as "the resonance frequency of the center conductor" in this specification, the resonance frequency can effectively be considered as "the resonance frequency of the coplanar waveguide resonator".

Figure 15A:
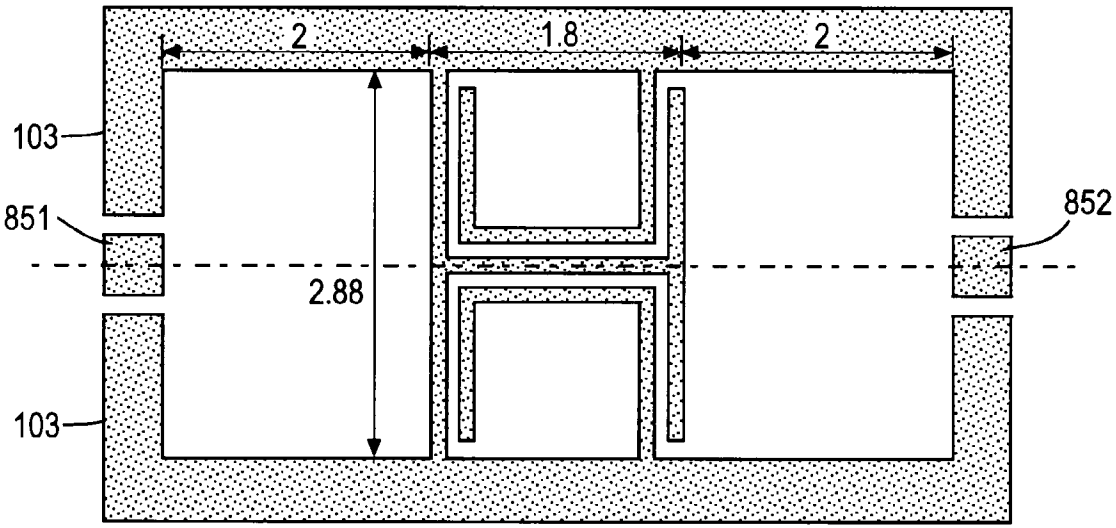
FIG. 15A is a plan view of the quarter-wavelength coplanar waveguide resonator shown in FIG. 7.
Figure 15B:
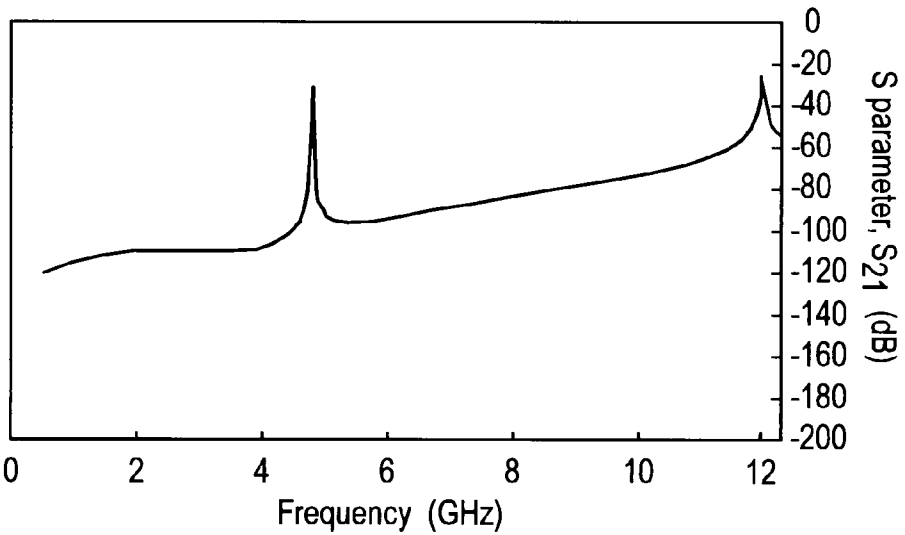
FIG. 15B is a graph showing frequency characteristics of the quarter-wavelength coplanar waveguide resonator shown in FIG. 15A.

FIG. 15A shows a configuration of the quarter-wavelength coplanar waveguide resonator 200*b* shown in FIG. 7. This drawing shows an example in which the width "a" of the gap sections 107*a* is 0.08 mm. FIG. 15B shows a relationship between the $S_{21}$ parameter (in decibel (dB)) and the frequency of the quarter-wavelength coplanar waveguide resonator 200*b*. As can be seen from this drawing, the resonance frequency $f_1$ (=8 GHz) of the center conductor 101 is split, and the center conductor resonates at a frequency $f_2$ (≈4.7 GHz) lower than the frequency $f_1$. In this simulation, the resonance frequency $f_1$ (=8 GHz) is split into at least two frequencies $f_2$ (≈4.7 GHz) and $f_3$ (≈12 GHz) as a result of formation of the base stubs 104.

Figure 16A:
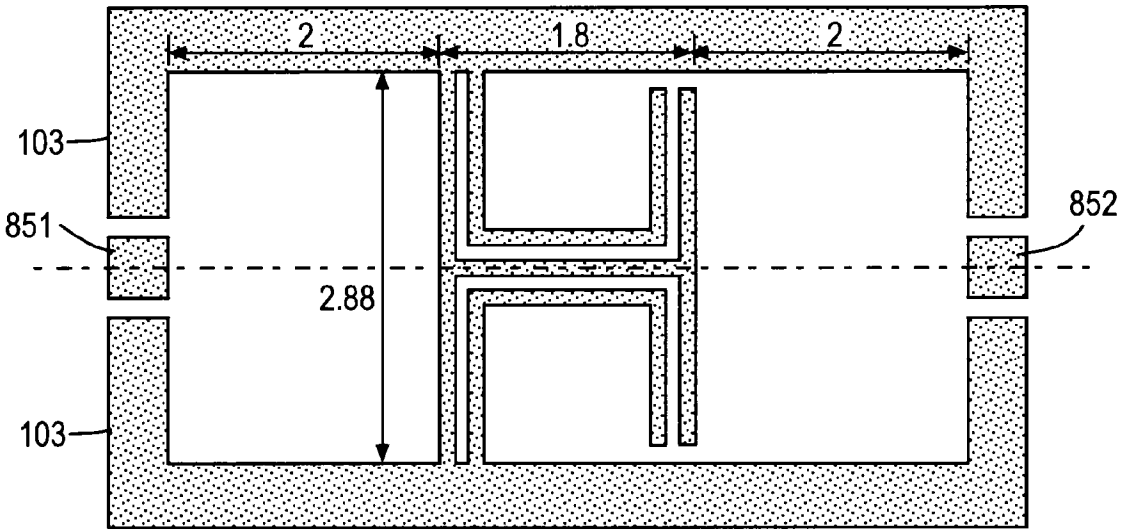
FIG. 16A is a plan view of a variation of the quarter-wavelength coplanar waveguide resonator shown in FIG. 7.
Figure 16B:
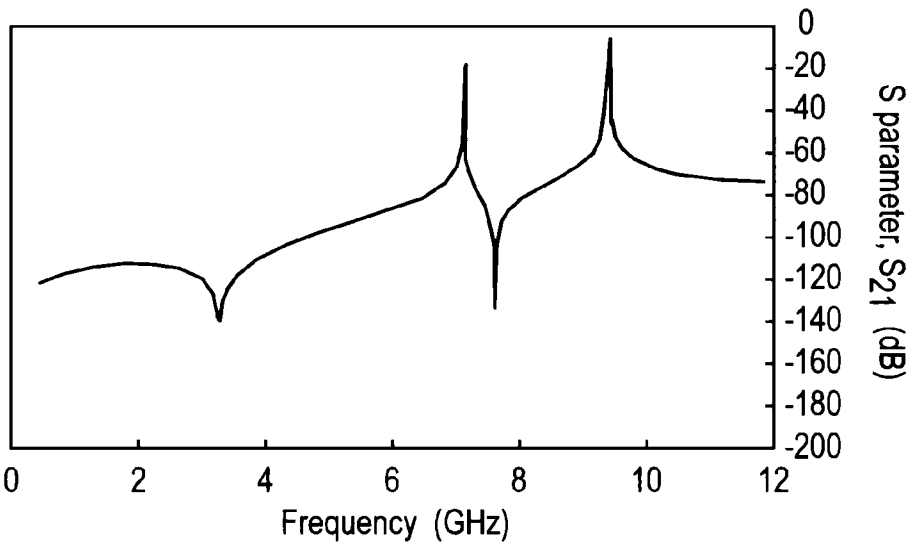
FIG. 16B is a graph showing frequency characteristics of the quarter-wavelength coplanar waveguide resonator shown in FIG. 16A.

FIG. 16A shows a configuration of a quarter-wavelength coplanar 10 waveguide resonator that differs from the quarter-wavelength coplanar waveguide resonator 200*b* shown in FIG. 7 in placement of the base stubs 104. In this quarter-wavelength coplanar waveguide resonator, the base stubs are disposed in a reverse position to the base stubs of the quarter-wavelength coplanar waveguide resonator 200*b*. That is, the root parts 104*d* of the base stubs 104 are disposed closer to the short-circuited line conductor 101*a* of the center conductor 101. FIG. 16B shows a relationship between the $S_{21}$ parameter (in decibel (dB)) and the frequency of the quarter-wavelength coplanar waveguide resonator. As can be seen from this drawing, the resonance frequency $f_1$ (=8 GHz) of the center conductor 101 is split, and the center conductor resonates at a frequency $f_2$ (≈7 GHz) lower than the frequency $f_1$. In this simulation, the resonance frequency $f_1$ (=8 GHz) is split into at least two frequencies $f_2$ (≈7 GHz) and $f_3$ (≈9.2 GHz) as a result of formation of the base stubs 104.

As is apparent from comparison between FIGS. 15B and 16B, the resonance frequency $f_1$ is more effectively split in the case where the root parts 104*d* of the base stubs 104, or the short-circuited ends, are disposed closer to the open-circuited end of the center conductor 101 as in the quarter-wavelength coplanar waveguide resonator 200*b* shown in FIG. 7 than in the case where the root parts 104*d* of the base stubs 104, or the short-circuited ends, are disposed close to the short-circuited line conductor 101*a* of the center conductor 101.

Figure 17A:
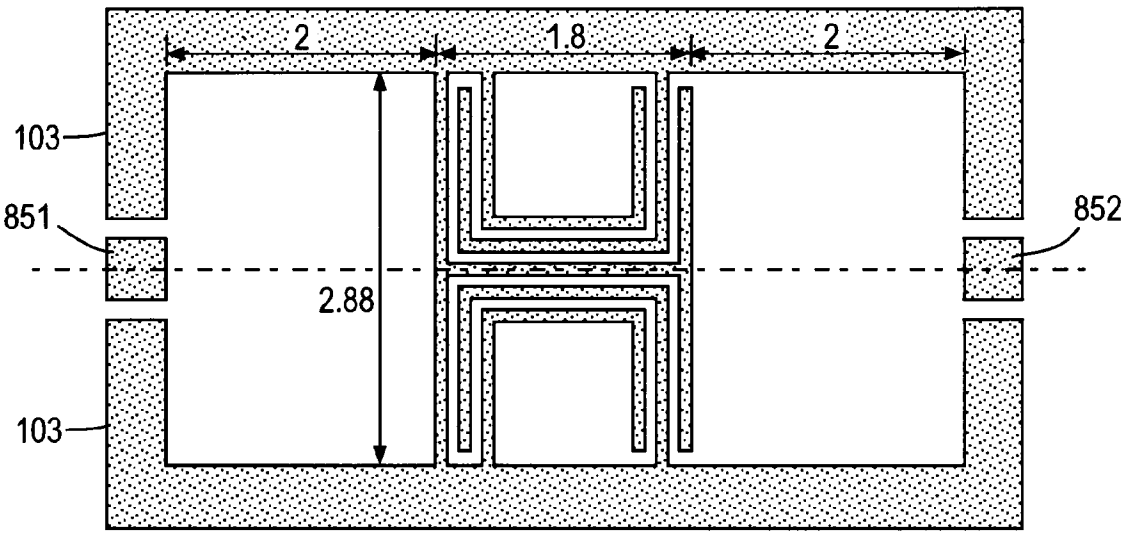
FIG. 17A is a plan view of a variation of the quarter-wavelength coplanar waveguide resonator shown in FIG. 7.
Figure 17B:
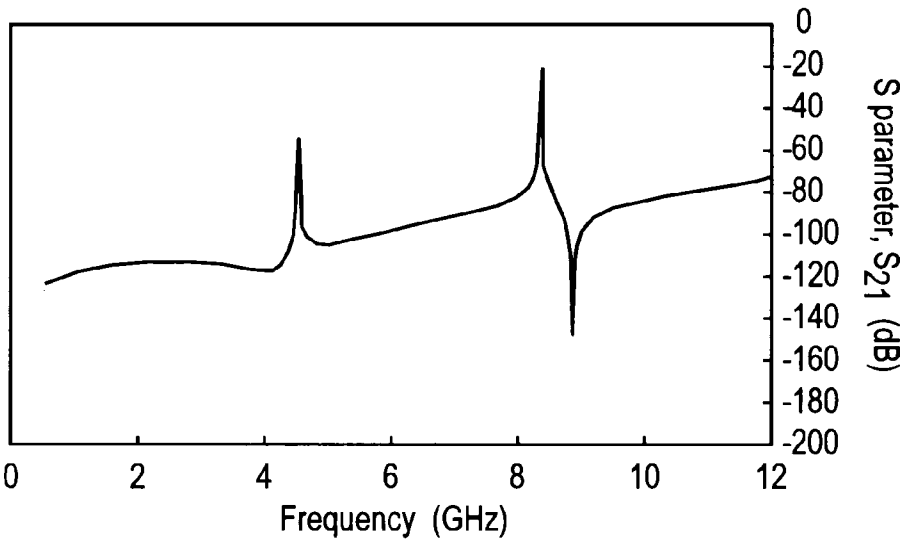
FIG. 17B is a graph showing frequency characteristics of the quarter-wavelength coplanar waveguide resonator shown in FIG. 17A.
Figure 18A:
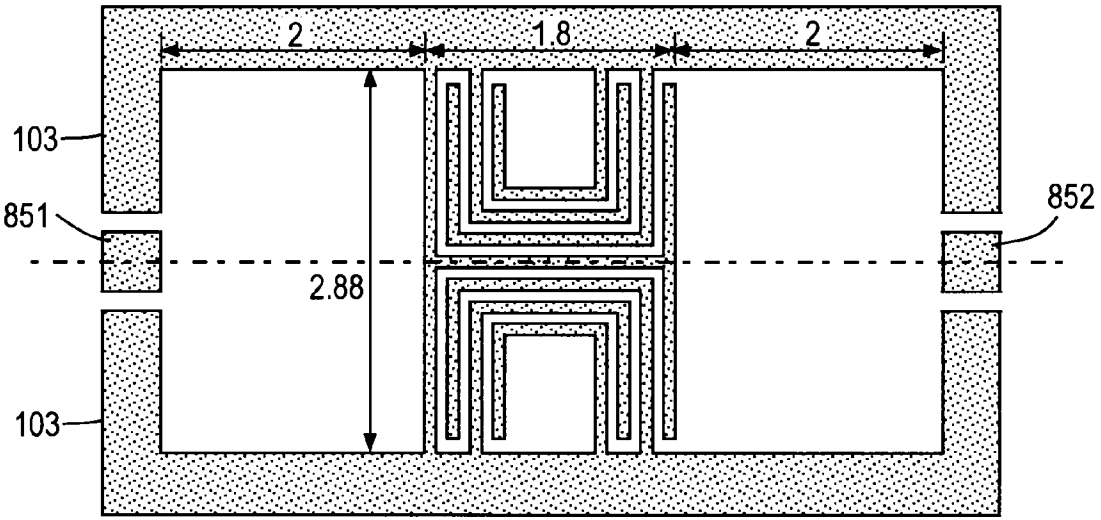
FIG. 18A is a plan view of a variation of the quarter-wavelength coplanar waveguide resonator shown in FIG. 7.
Figure 18B:
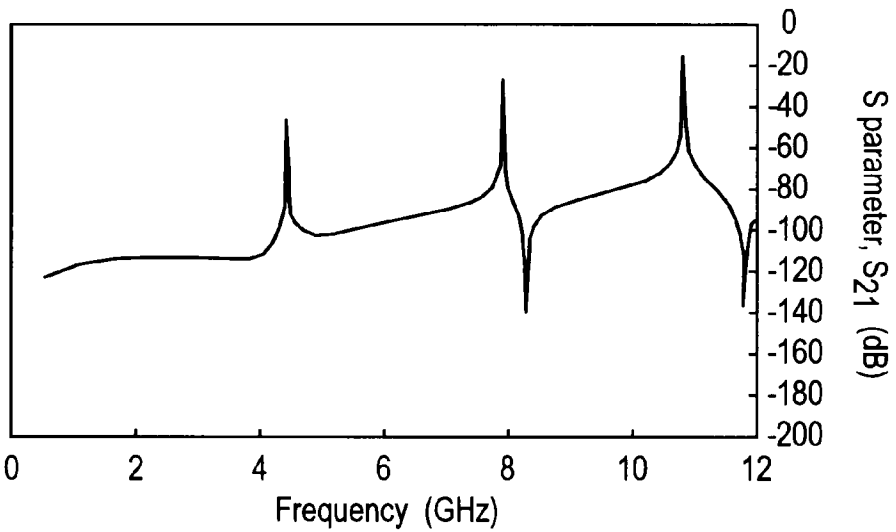
FIG. 18B is a graph showing frequency characteristics of the quarter-wavelength coplanar waveguide resonator shown in FIG. 18A.

FIGS. 17B and 18B show electromagnetic simulation results showing the way that the resonance frequency $f_1$ of the center conductor 101 varies in cases where the quarter-wavelength coplanar waveguide resonator 200*b* has one or two downsized stubs disposed in an interdigital and nested configuration on each side of the center conductor.

FIG. 17A shows a configuration of the quarter-wavelength coplanar waveguide resonator 200*b* shown in FIG. 7 in which one downsized stub is additionally provided in an interdigital and nested configuration on each side of the center conductor. That is, the quarter-wavelength coplanar waveguide resonator is the same as the quarter-wavelength coplanar waveguide resonator 300*b* shown in FIG. 12. In the electromagnetic simulation, the width of the center conductor 101 is 0.08 mm, the distance between the short-circuited line conductor 101*a* and the line conductor 101*f* is 1.80 mm, and the distance between the peripheral edges 103*a* that are parallel to the center line conductor 101*b* is 2.88 mm. Each width of the gap section 107*d* and the gap section 107*c* in the input/output direction is 2.00 mm. The quarter-wavelength coplanar waveguide resonator is designed so that the center conductor 101 resonates at 8 GHz. The value of the U-shaped gap width between the center conductor 101 and the base stubs 104 and the value of the U-shaped gap width between the base stubs 104 and the downsized stubs 108 are equal to each other and 2.00 mm. FIG. 17B shows a relationship between the $S_{21}$ parameter (in decibel (dB)) and the frequency of the quarter-wavelength coplanar waveguide resonator 300*b*. As can be seen from this drawing, the resonance frequency $f_1$ (=8 GHz) of the center conductor 101 is split, and the center conductor 101 resonates at a frequency $f_2$ (≈4.5 GHz) lower than the frequency $f_1$. In this simulation, the resonance frequency $f_1$ (=8 GHz) is split into at least two frequencies $f_2$ (≈4.5 GHz) and $f_3$ (≈8.5 GHz) as a result of formation of the base stub 104 and the downsized stubs 108.

FIG. 18A shows a configuration of the quarter-wavelength coplanar waveguide resonator 200*b* shown in FIG. 7 in which two downsized stubs are additionally provided in an interdigital and nested configuration on each side of the center conductor. That is, the quarter-wavelength coplanar waveguide resonator is the same as the quarter-wavelength coplanar waveguide resonator 300*b* shown in FIG. 17A in which one downsized stub is additionally provided on each side of the center conductor 101. In addition, the value of the U-shaped gap width between the center conductor 101 and the base stubs 104, the value of the U-shaped gap width between the base stubs 104 and the first downsized stubs 108, and the value of the U-shaped gap width between the first downsized stubs 108 and the second downsized stubs 108' are equal to each other and 0.08 mm. FIG. 18B shows a relationship between the $S_{21}$ parameter (in decibel (dB)) and the frequency of the quarter-wavelength coplanar waveguide resonator. As can be seen from this drawing, the resonance frequency $f_1$ (=8 GHz) of the center conductor 101 is split, and the center conductor 101 resonates at a frequency $f_2$ (≈4.4 GHz) lower than the frequency $f_1$. In this simulation, the resonance frequency $f_1$ (=8 GHz) is split into at least two frequencies $f_2$ (≈4.4 GHz) and $f_3$ (≈7.9 GHz) as a result of formation of the base stub 104 and two downsized stubs on each side of the center conductor 101.

Figure 19A:
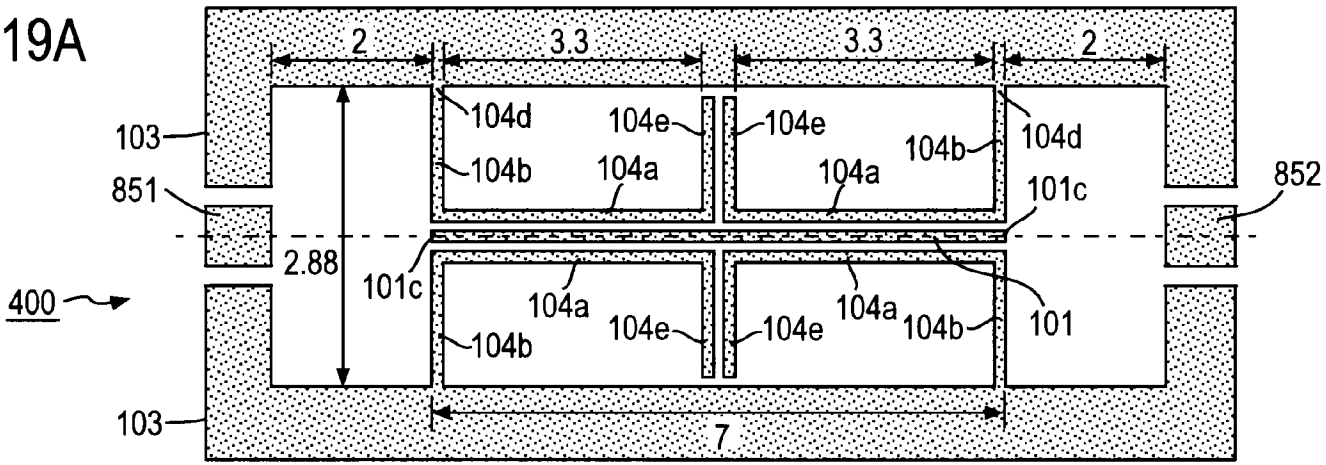
FIG. 19A is a plan view of a half-wavelength coplanar waveguide resonator according to an embodiment of the present invention.

FIG. 19A shows a half-wavelength coplanar waveguide resonator 400 according to another embodiment of the present invention.

For example, the half-wavelength coplanar waveguide resonator 400 comprises a ground conductor 103 disposed on a surface of a dielectric substrate 105 illustrated as the shape of a rectangular plate, and a center conductor 101 and four line conductors 104 formed by patterning the ground conductor 103 by etching. Input/output terminals 851 and 852 are provided on the opposite ends (the left and right ends of the coplanar waveguide resonator when the drawing is viewed straight from the front) of the coplanar waveguide resonator shown.

The center conductor 101 is a straight line conductor open-circuited at the opposite ends, and the physical length thereof is designed to have an electrical length corresponding to a half wavelength at a resonance frequency $f_1$. The center conductor 101 is surrounded by a gap section, and the four line conductors 104 are disposed in the gap section.

The center conductor 101 is disposed so that open-circuited ends 101*c* thereof face the input/output terminals 851 and 852, respectively. That is, the center conductor 101 extends in the input/output direction of the half-wavelength coplanar waveguide resonator 400.

The shape of the line conductors 104 used in the half-wavelength coplanar waveguide resonator 400 shown in FIG. 19A are the same as that of the base stubs 104 used in the quarter-wavelength coplanar waveguide resonator 100*b* shown in FIG. 4. Of course, the line conductors having the similar shape to that of the base stubs 104 used in the quarter-wavelength coplanar waveguide resonator 100*a* shown in FIG. 1 or the quarter-wavelength coplanar waveguide resonator 100*c* shown in FIG. 5 can also be used, for example.

Each base stub 104 is connected to the ground conductor 103 at a root part 104*d* thereof, and the root parts 104*d* are disposed closer to the open-circuited ends 101*c* of the center conductor 101 and connected to peripheral edges 103*a* of the ground conductor 103 that are parallel to the center conductor 101. In other words, the four base stubs 104 are disposed in the gap section surrounding the center conductor 101 symmetrically with respect to the line of extension of the center conductor 101 and with respect to the line perpendicularly passing through the center of the center conductor 101. The two base stubs 104 on each side of the center conductor 101 have respective second collateral line conductors 104*e*, which are disposed to face each other.

In the half-wavelength coplanar waveguide resonator 400 shown in FIG. 19A, each of the open-circuited ends 101*c* of the center conductor 101 is located substantially in line with the root parts 104*d* of two base stubs 104. However, such a positional relationship is not essential to the present invention.

In the half-wavelength coplanar waveguide resonator 400, since the first collateral line conductors 104*a* of the base stubs 104 are disposed close to the center conductor 101, the resonance frequency $f_1$ of the center conductor 101 can be split, and the center conductor 101 can be made to resonate at a frequency $f_2$ lower than the frequency $f_1$.

Figure 20A:
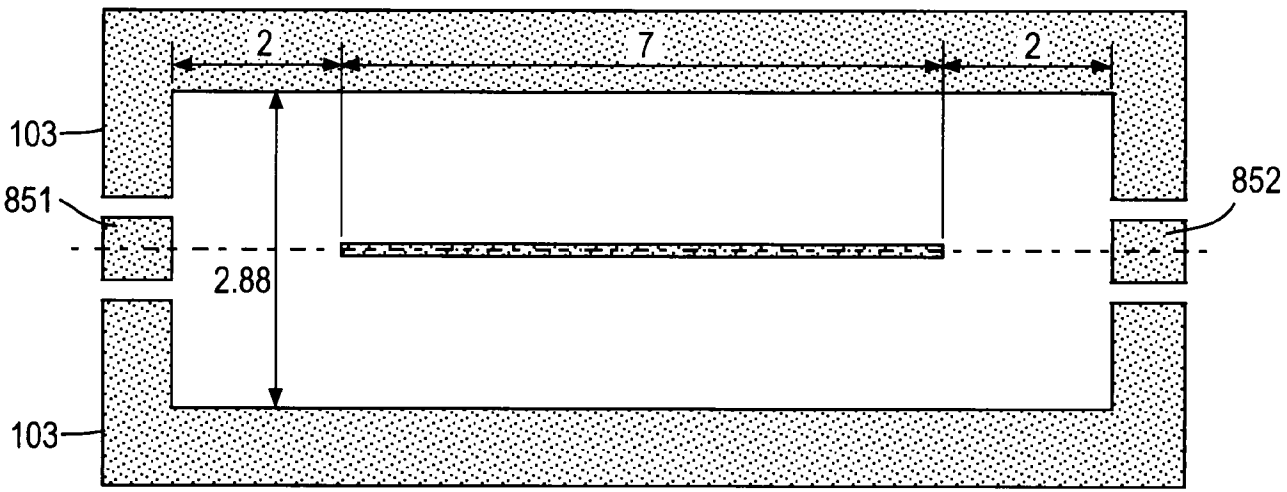
FIG. 20A PRIOR ART
FIG. 20A is a plan view of a conventional half-wavelength coplanar waveguide resonator.
Figure 20B:
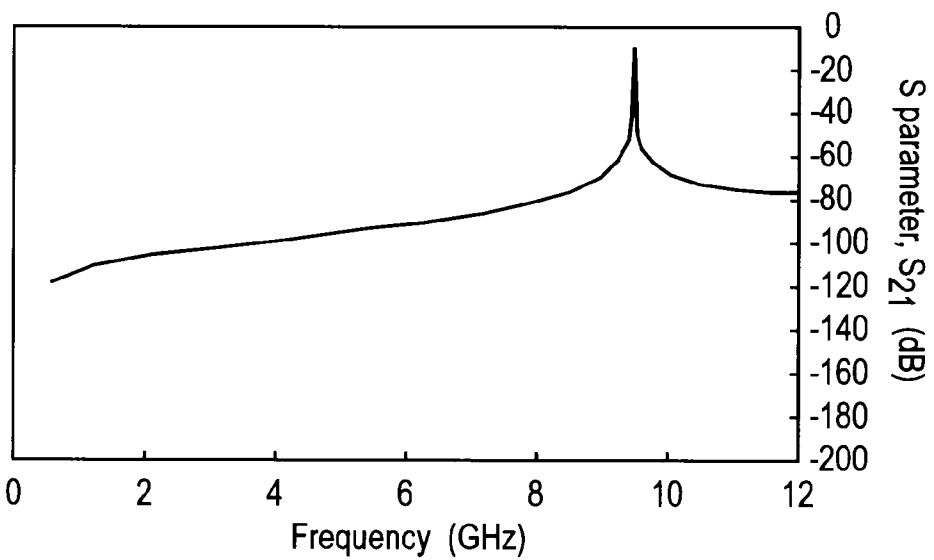
FIG. 20B PRIOR ART
FIG. 20B is a graph showing frequency characteristics of the half-wavelength coplanar waveguide resonator shown in FIG. 20A.

In the electromagnetic simulation, the total length of the center conductor 101 is 7.00 mm, the width of the center conductor 101 is 0.08 mm, the length of the part of each base stub 104 that is parallel to the center conductor 101 is 3.30 mm, and the distance between the peripheral edges 103*a* of the ground conductor 103 that are parallel to the center conductor 101 is 2.88 mm. The distance between the input/output terminal 851 and one of two open-circuited ends of the center conductor 101 is 2.00 mm, and the distance between the input/output terminal 852 and the other one of two open-circuited ends of the center conductor 101 is 2.00 mm. The half-wavelength coplanar waveguide resonator is designed so that the center conductor 101 resonates at 9.5 GHz. FIG. 20B shows a relationship between the $S_{21}$ parameter (in decibel (dB)) and the frequency of a conventional half-wavelength coplanar waveguide resonator that is designed to resonate at 9.5 GHz (see FIG. 20A).

Figure 19B:
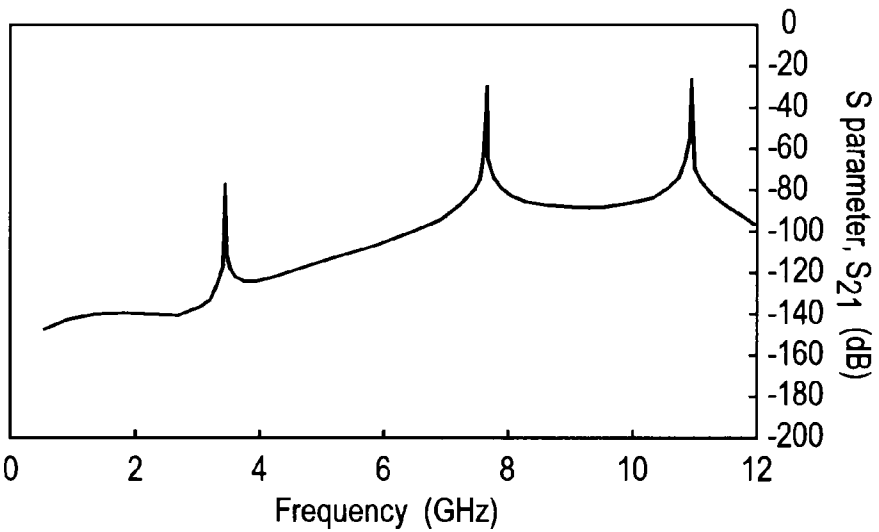
FIG. 19B is a graph showing frequency characteristics of the half-wavelength coplanar waveguide resonator shown in FIG. 19A.

FIG. 19B shows a relationship between the $S_{21}$ parameter (in decibel (dB)) and the frequency of the half-wavelength coplanar waveguide resonator 400 shown in FIG. 19A. As can be seen from this drawing, the resonance frequency $f_1$ (=9.5 GHz) of the center conductor 101 is split, and the center conductor 101 resonates at a frequency $f_2$ (≈3.4 GHz) lower than the frequency $f_1$. In this simulation, the resonance frequency $f_1$ (=9.5 GHz) is split into at least three frequencies $f_2$ (≈3.4 GHz), $f_3$ (≈7.7 GHz) and $f_4$ (≈11 GHz) as a result of formation of the four base stubs 104.

As with the quarter-wavelength coplanar waveguide resonators described above, the center conductor for a desired frequency can be designed and fabricated as a line conductor having a physical length corresponding to an electrical length equivalent to a half wavelength at a frequency higher than the desired frequency, and since the half-wavelength coplanar waveguide resonator has a simple structure in which the base stubs 104 are additionally provided in the gap section between the center line conductor 101 and the ground conductor 103, the half-wavelength coplanar waveguide resonator is miniaturized compared with conventional half-wavelength coplanar waveguide resonators.

Figure 21A:
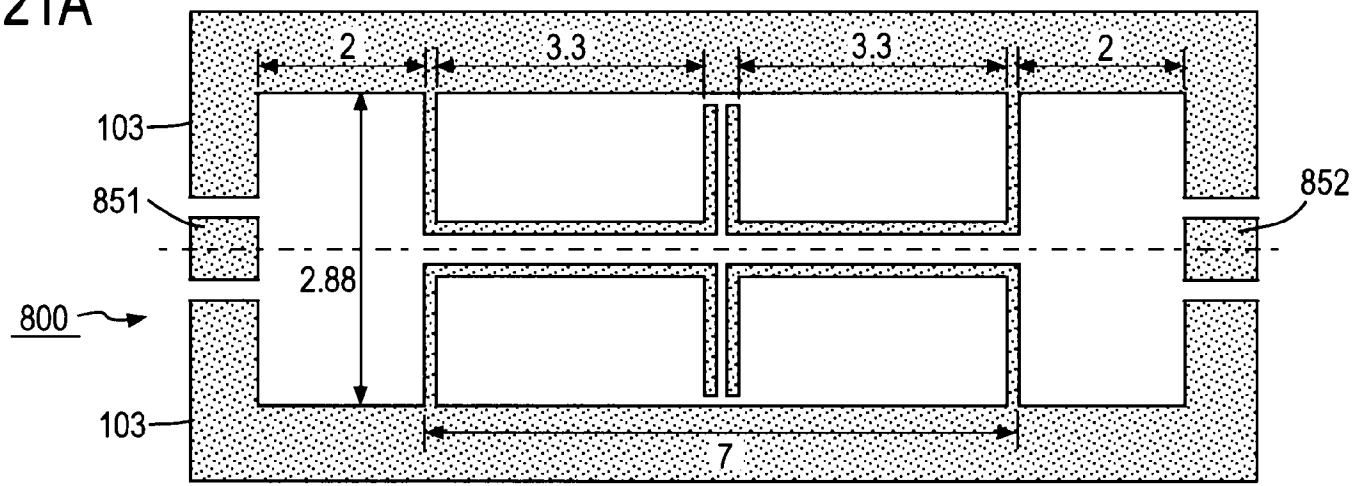
FIG. 21A is a plan view of the half-wavelength coplanar waveguide resonator shown in FIG. 1 9A from which a center conductor is removed.
Figure 21B:
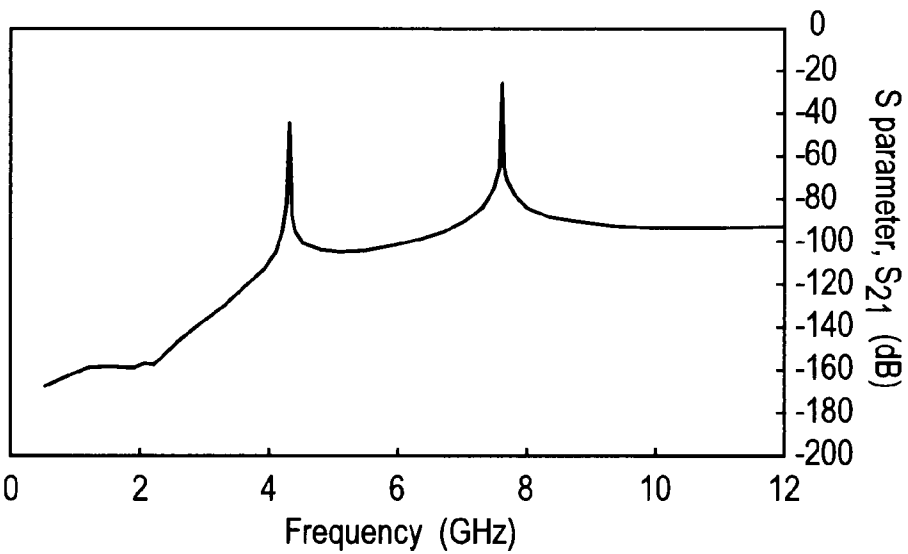
FIG. 21B is a graph showing frequency characteristics of the half-wavelength coplanar waveguide resonator shown in FIG. 21A.

For reference, FIG. 21A shows a configuration of a coplanar waveguide resonator 800, which is the half-wavelength coplanar waveguide resonator 400 shown in FIG. 19A from which the center conductor 101 is removed, and FIG. 21B shows a relationship between the $S_{21}$ parameter (in decibel (dB)) and the frequency of the coplanar waveguide resonator 800 having this configuration.

The coplanar waveguide resonator 800 having this configuration has a resonance frequencies of about 4.3 GHz and about 7.7 GHz. Therefore, the resonance frequency $f_2$ (≈3.4 GHz) of the half-wavelength coplanar waveguide resonator 400 shown in FIG. 19A is not a resonance frequency of the coplanar waveguide resonator 800 shown in FIG. 21A. In addition, the half-wavelength coplanar waveguide resonator 400 shown in FIG. 19A has a resonance frequency lower than the resonance frequencies of the coplanar waveguide resonator 800 shown in FIG. 21A and the resonance frequency of the half-wavelength coplanar waveguide resonator shown in FIG. 20A.

Next, a coplanar waveguide filter according to an embodiment of the present invention, which is composed of a plurality of coplanar waveguide resonators according to the present invention connected in series with each other, will be described.

Figure 22:
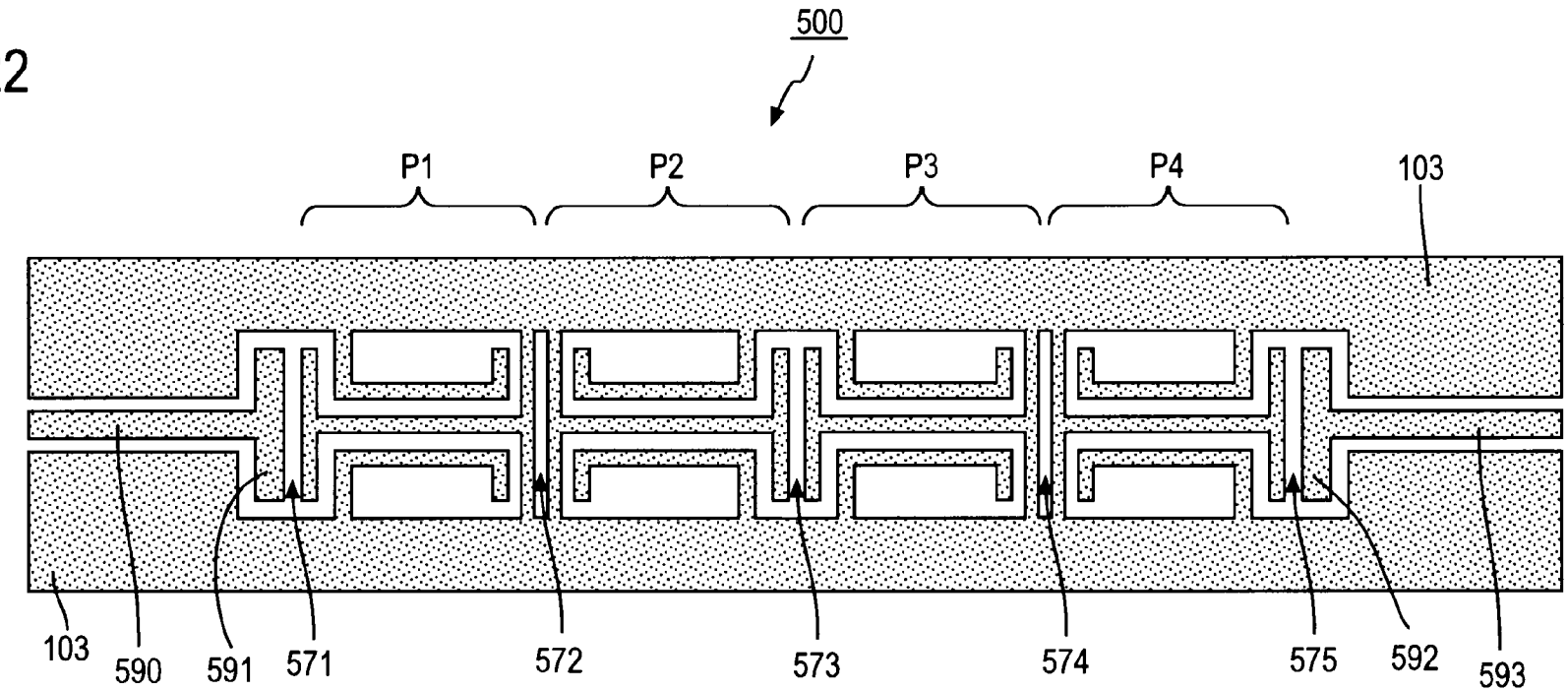
FIG. 22 is a plan view of a coplanar waveguide filter according to an embodiment of the present invention in the case where quarter-wavelength coplanar waveguide resonators are used.

FIG. 22 shows a coplanar waveguide filter 500, which is composed of four quarter-wavelength coplanar waveguide resonators 200*b* shown in FIG. 7 electromagnetically connected in series with each other.

On a dielectric substrate 105 illustrated as the shape of a rectangular plate, an input/output terminal 590 is formed at a position close to one end of the dielectric substrate 105 in the longitudinal direction by etching a ground conductor 103. The input/output terminal 590 is a line conductor formed to extend in the longitudinal direction of the dielectric substrate 105. The ground conductors 103 are disposed on the both sides of the input/output terminal 590 with gap sections interposed therebetween. A line conductor 591 that has the same width as the input/output terminal 590 and extends in the direction perpendicular to the longitudinal direction of the dielectric substrate 105 is connected to one end of the input/output terminal 590 at the center thereof.

In addition, on the dielectric substrate 105, an input/output terminal 593 is formed at a position close to the other end of the dielectric substrate 105 in the longitudinal direction by etching the ground conductor 103. The input/output terminal 593 is a line conductor formed to extend in the longitudinal direction of the dielectric substrate 105. The ground conductors 103 are disposed on the both sides of the input/output terminal 593 with gap sections interposed therebetween. A line conductor 592 that has the same width as the input/output terminal 593 and extends in the direction perpendicular to the longitudinal direction of the dielectric substrate 105 is connected to one end of the input/output terminal 593 at the center thereof.

A quarter-wavelength coplanar waveguide resonator P1, which is the quarter-wavelength coplanar waveguide resonator shown in FIG. 7, is formed in such a manner that the line conductor 101*f* of the quarter-wavelength coplanar waveguide resonator P1 faces the longer side of the line conductor 591 with a gap section 571 interposed therebetween.

Furthermore, a quarter-wavelength coplanar waveguide resonator P2, which is the quarter-wavelength coplanar waveguide resonator shown in FIG. 7, is formed in such a manner that the short-circuited line conductor 101*a* of the quarter-wavelength coplanar waveguide resonator P2 faces the short-circuited line conductor 101*a* of the quarter-wavelength coplanar waveguide resonator P1 with a gap section 572 interposed therebetween.

The quarter-wavelength coplanar waveguide resonator P1 and the quarter-wavelength coplanar waveguide resonator P2 are disposed so that the gap section 572 doubles as the gap sections 107*d* of the two quarter-wavelength coplanar waveguide resonators P1 and P2. That is, the quarter-wavelength coplanar waveguide resonators P1 and P2 are disposed in inversion symmetry. The term "symmetry" refers only to the shape thereof and does not mean that the quarter-wavelength coplanar waveguide resonators have the same size.

Furthermore, similarly, a quarter-wavelength coplanar waveguide resonator P3, which is the quarter-wavelength coplanar waveguide resonator shown in FIG. 7, is formed in such a manner that the line conductor 101*f* of the quarter-wavelength coplanar waveguide resonator P3 faces the line conductor 101*f* of the quarter-wavelength coplanar waveguide resonator P2 with a gap section 573 interposed therebetween.

Furthermore, a quarter-wavelength coplanar waveguide resonator P4, which is the quarter-wavelength coplanar waveguide resonator shown in FIG. 7, is formed in such a manner that the short-circuited line conductor 101*a* of the quarter-wavelength coplanar waveguide resonator P4 faces the short-circuited line conductor 101*a* of the quarter-wavelength coplanar waveguide resonator P3 with a gap section 574 interposed therebetween. The line conductor 101*f* of the quarter-wavelength coplanar waveguide resonator P4 faces the longer side of the line conductor 592 with a gap section 575 interposed therebetween.

As described above, the coplanar waveguide filter 500 is composed of the four quarter-wavelength coplanar waveguide resonators P1, P2, P3 and P4 that are connected in series with each other in the input/output direction in such a manner that adjacent two quarter-wavelength coplanar waveguide resonators are disposed in inverted orientations.

Figure 23:
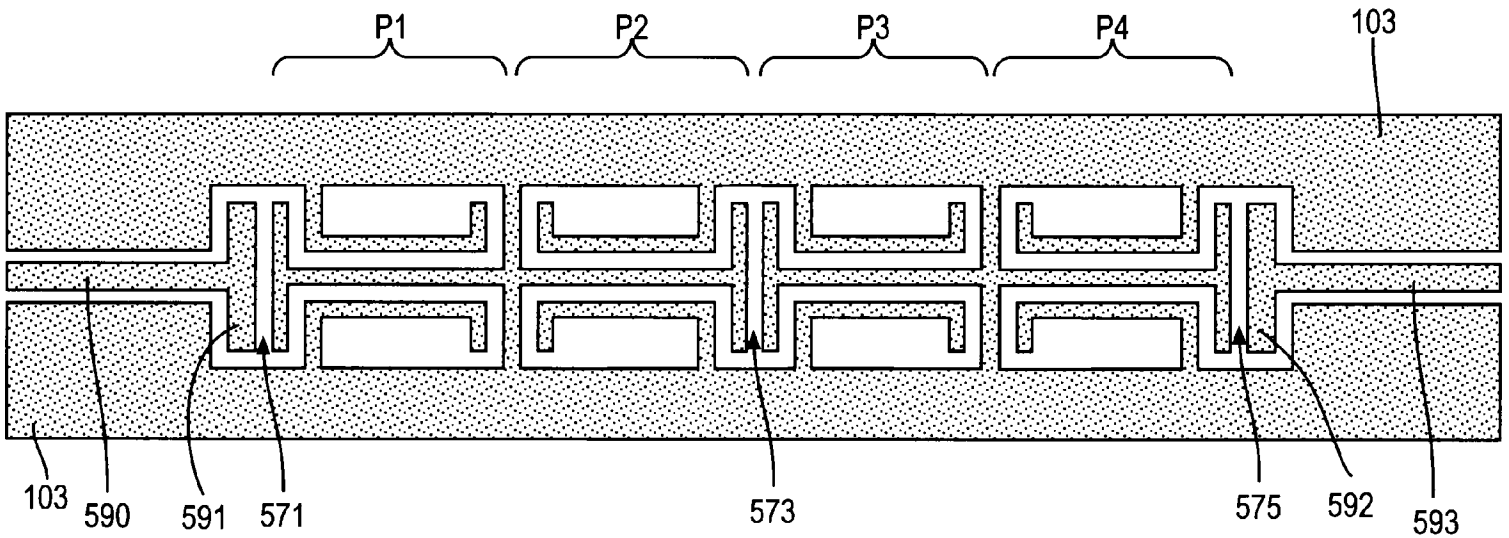
FIG. 23 is a plan view of a coplanar waveguide filter (a variation) according to the embodiment of the present invention in the case where quarter-wavelength coplanar waveguide resonators are used.

As an alternative embodiment, the gap sections 572 and 574 of the coplanar waveguide filter 500 shown in FIG. 22 can be omitted (see FIG. 23). The coplanar waveguide filter shown in FIG. 23 is also composed of four quarter-wavelength coplanar waveguide resonators P1, P2, P3 and P4 that are connected in series with each other in the input/output direction in such a manner that adjacent two quarter-wavelength coplanar waveguide resonators are disposed in inverted orientations.

FIGS. 22 and 23 show coplanar waveguide filters composed of four quarter-wavelength coplanar waveguide resonators 200*b* shown in FIG. 7 that are connected in series with each other in such a manner that adjacent two quarter-wavelength coplanar waveguide resonators are disposed in inverted orientations. However, this does not mean that the number of the quarter-wavelength coplanar waveguide resonators 200*b* connected in series is limited to four. In general, for example, a quarter-wavelength coplanar waveguide resonator P1 and a quarter-wavelength coplanar waveguide resonator P2 disposed in inverted orientations are paired, and a coplanar waveguide filter can be composed of a plurality of such pairs connected in series with each other. In addition, the quarter-wavelength coplanar waveguide resonators forming the coplanar waveguide filter are not limited to the quarter-wavelength coplanar waveguide resonators 200*b* shown in FIG. 7, and any of the quarter-wavelength coplanar waveguide resonators described above can be used.

Alternatively, a coplanar waveguide filter can be composed of half-wavelength coplanar waveguide resonators according to an embodiment of the present invention.

Figure 24:
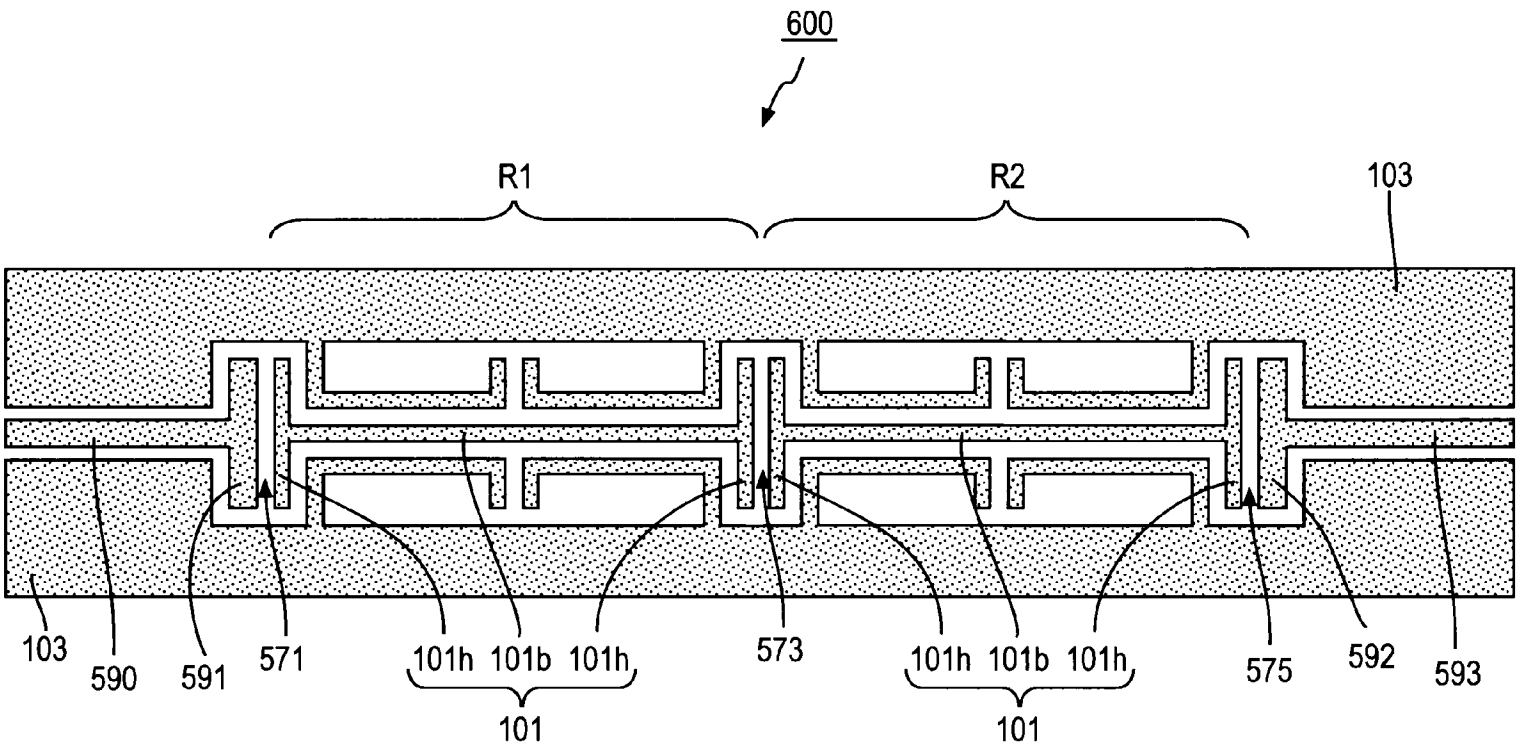
FIG. 24 is a plan view of a coplanar waveguide filter according to an embodiment of the present invention in the case where half-wavelength coplanar waveguide resonators are used.

FIG. 24 shows an example of a coplanar waveguide filter 600 composed of half-wavelength coplanar waveguide resonators according to an embodiment of the present invention. The half-wavelength coplanar waveguide resonators used in the coplanar waveguide filter 600 are a variation of the half-wavelength coplanar waveguide resonator 400 shown in FIG. 19A. The variation differs from the half-wavelength coplanar waveguide resonator 400 in that the two open-circuited ends 101*c* of the center conductor 101 are branched in two directions so that each end part of the center conductor 101 has an H-shape. According to this variation, the center conductor 101 is composed of two line conductors 101*h*, which are straight line conductors open-circuited at the opposite ends, and a center line conductor 101*b*, which is a line conductor connecting the line conductors 101*h* to each other at the center thereof, and the physical lengths of the center line conductor 101*b* and the two line conductors 101*h* are designed to have an electrical length equivalent to a half wavelength at the resonance frequency $f_1$. In addition, the first collateral line conductors 104*a* of the four base stubs 104 are disposed to have a uniform distance from the center line conductor 101*b*. The line conductors 104*b* of the base stubs 104 are disposed to have a uniform distance from the line conductors 101*h* of the center conductor 101.

In the coplanar waveguide filter 600, two half-wavelength coplanar waveguide resonators, which are the variation of the half-wavelength coplanar waveguide resonator 400 described above, are disposed in a gap section between input/output terminals 590 and 593 and electromagnetically connected in series with each other. Specifically, one of the line conductors 101*h* of a half-wavelength coplanar waveguide resonator R1, which is the variation of the half-wavelength coplanar waveguide resonator 400 described above, faces the longer side of a line conductor 591 with a gap section 571 interposed therebetween, the other of the line conductors 101*h* of the half-wavelength coplanar waveguide resonator R1 faces one of the line conductors 101*h* of a half-wavelength coplanar waveguide resonator R2, which is the variation of the half-wavelength coplanar waveguide resonator 400, with a gap section 573 interposed therebetween, and the other of the line conductors 101*h* of the half-wavelength coplanar waveguide resonator R2 faces the longer side of a line conductor 592 with a gap section 575 interposed therebetween.

Of course, the coplanar waveguide filter can be composed of three or more half-wavelength coplanar waveguide resonators, which are the variation of the half-wavelength coplanar waveguide resonator 400, connected in series with each other. Furthermore, the half-wavelength coplanar waveguide resonators forming the coplanar waveguide filter are not limited to the variation of the half-wavelength coplanar waveguide resonator 400 described above.

Since the coplanar waveguide filter described above as an example uses the coplanar waveguide resonators according to the present invention, the total length of the coplanar waveguide filter in the direction of the series connection of the coplanar waveguide resonators is reduced compared with connectional coplanar waveguide filters. In addition to the reduction in total length, since any of the coplanar waveguide resonators according to the present invention has a simple structure in which the base stubs 104 are additionally provided in the gap sections between the center line conductor and the ground conductor, the coplanar waveguide filter is miniaturized compared with conventional coplanar waveguide filters.

Figure 25:
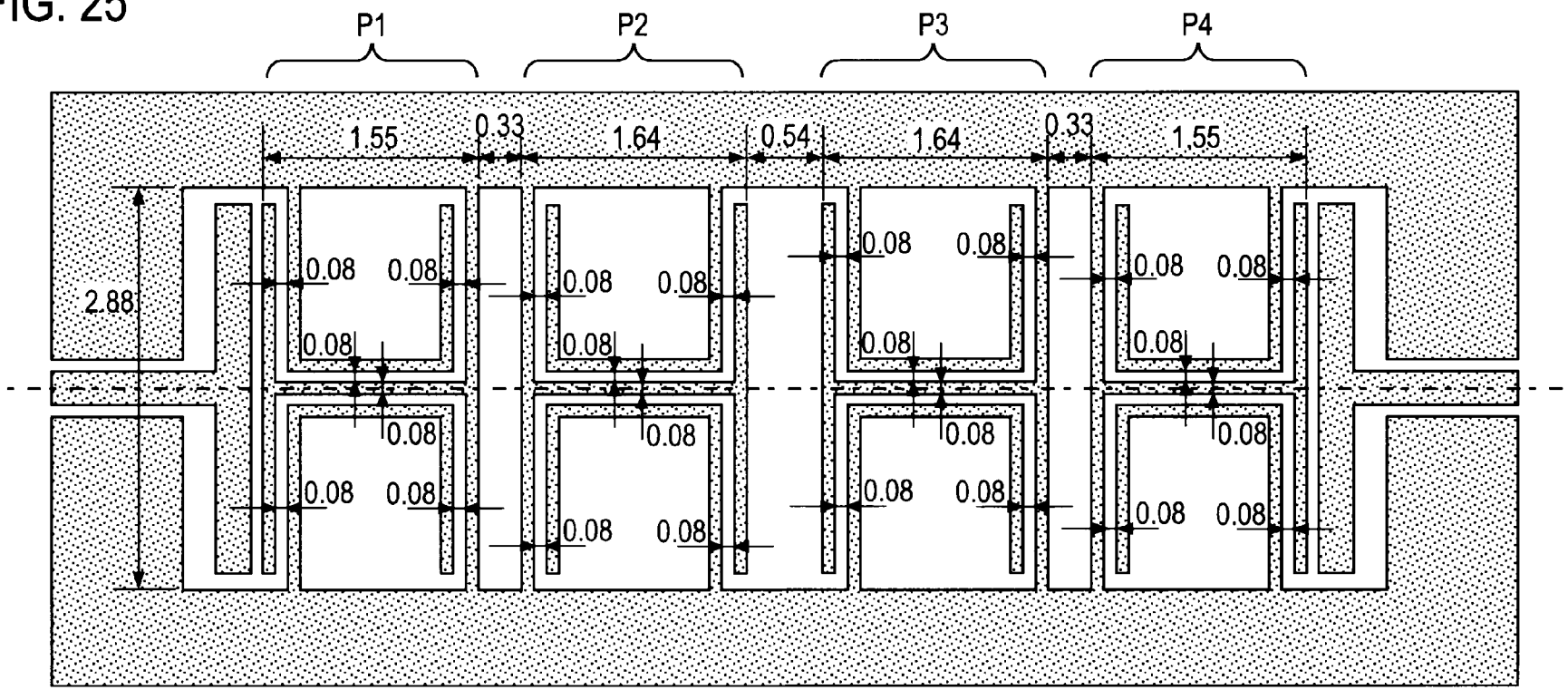
FIG. 25 is a plan view of a coplanar waveguide filter used for an electromagnetic simulation.
Figure 26A:
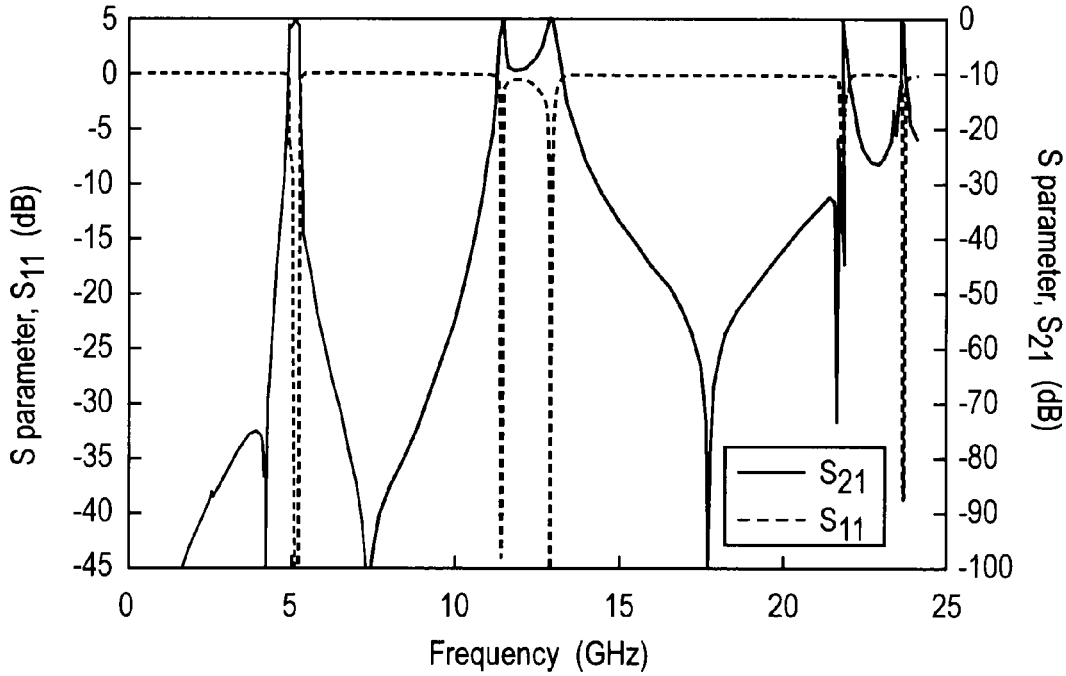
FIG. 26A is a graph showing frequency characteristics of the coplanar waveguide filter shown in FIG. 25.
Figure 26B:
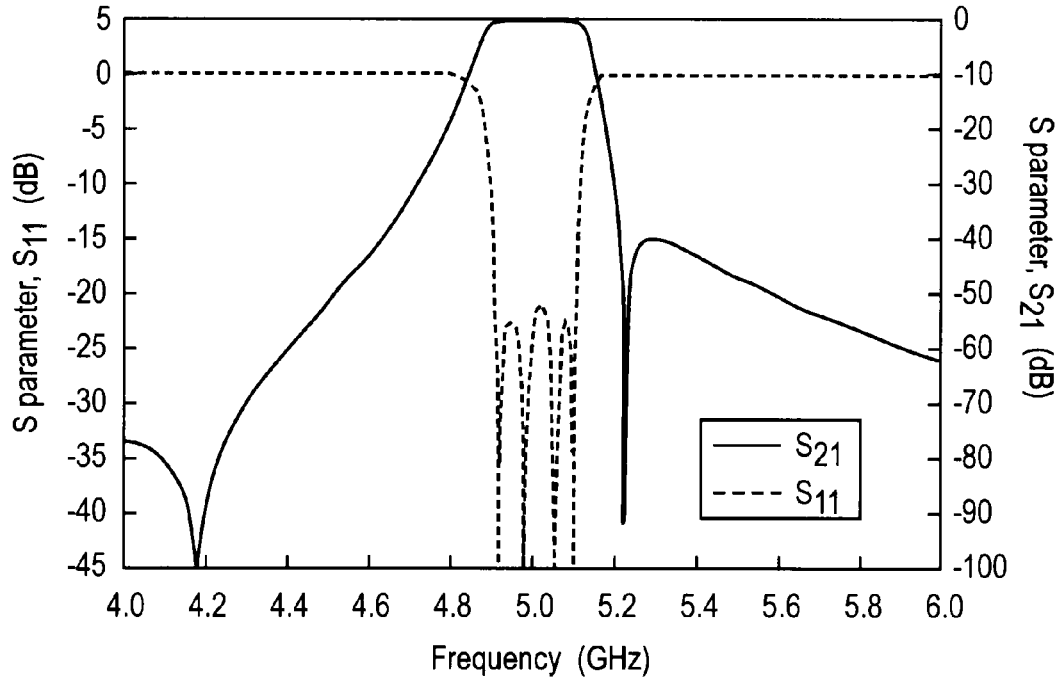
FIG. 26B is an enlarged view of a band around 5 GHz in FIG. 26A.
Figure 27:
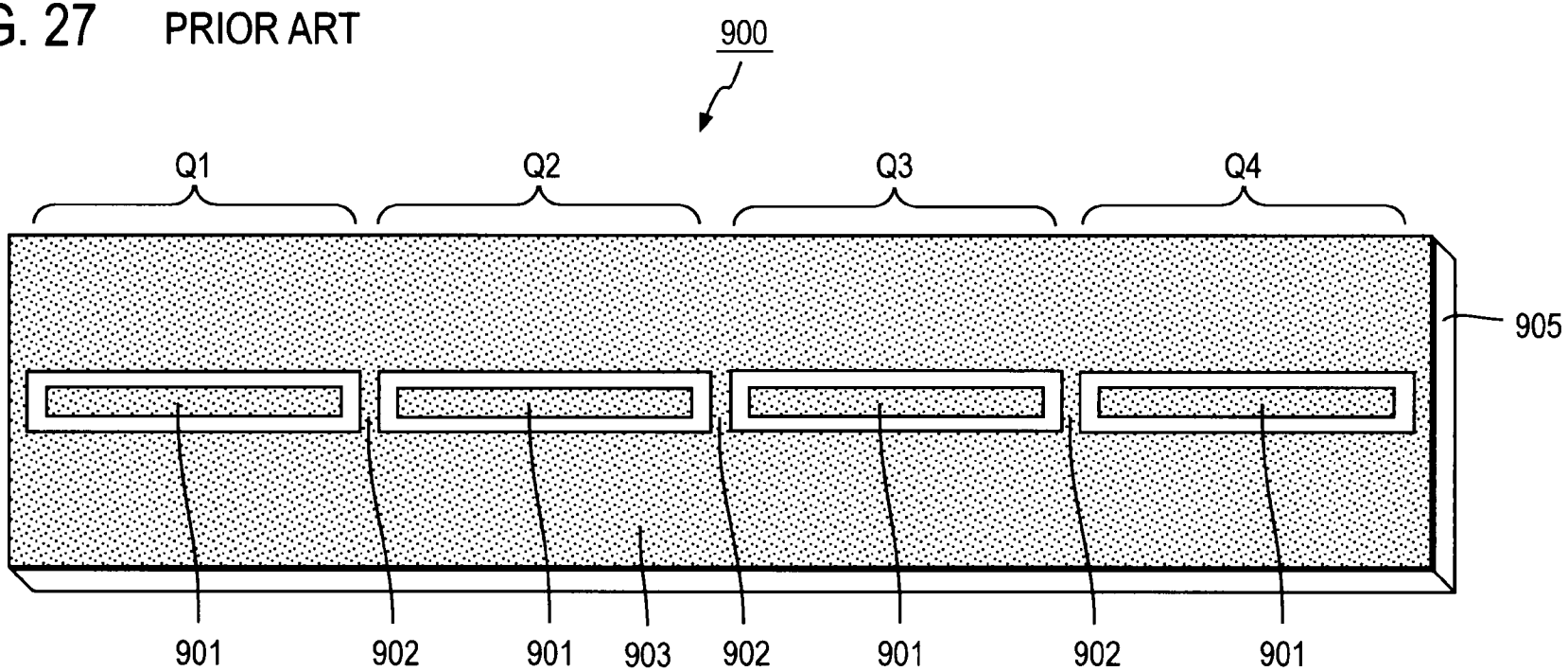
FIG. 27 PRIOR ART
FIG. 27 is a schematic perspective view of a conventional coplanar waveguide filter in the case where half-wavelength coplanar waveguide resonators are used.
Figure 28:
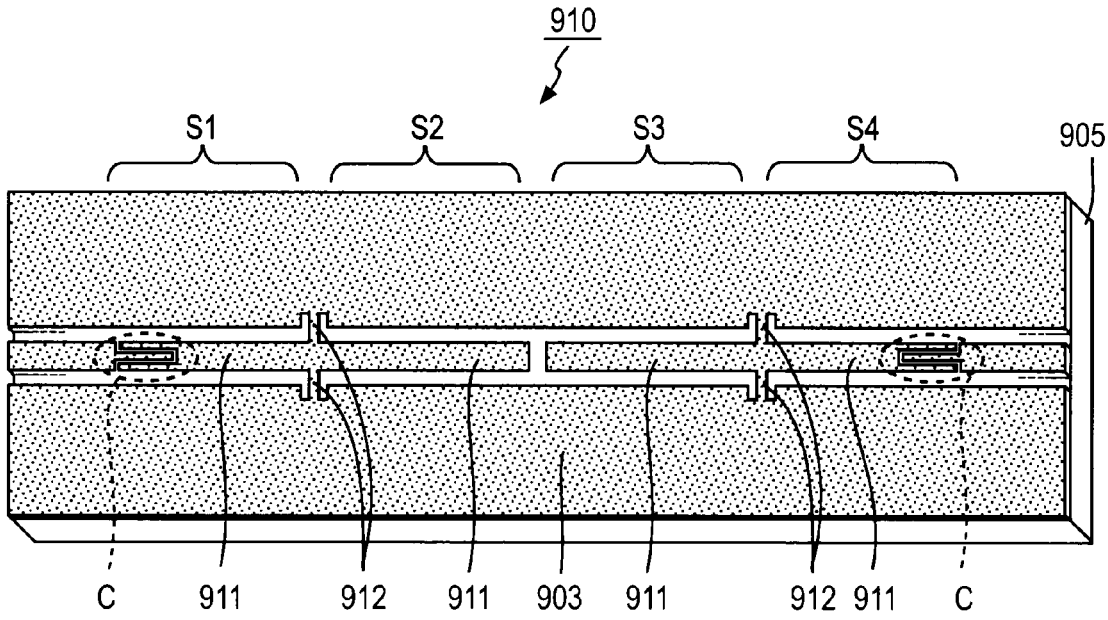
FIG. 28 PRIOR ART
FIG. 28 is a schematic perspective view of a conventional coplanar waveguide filter in the case where quarter-wavelength coplanar waveguide resonators are used.
Figure 29:
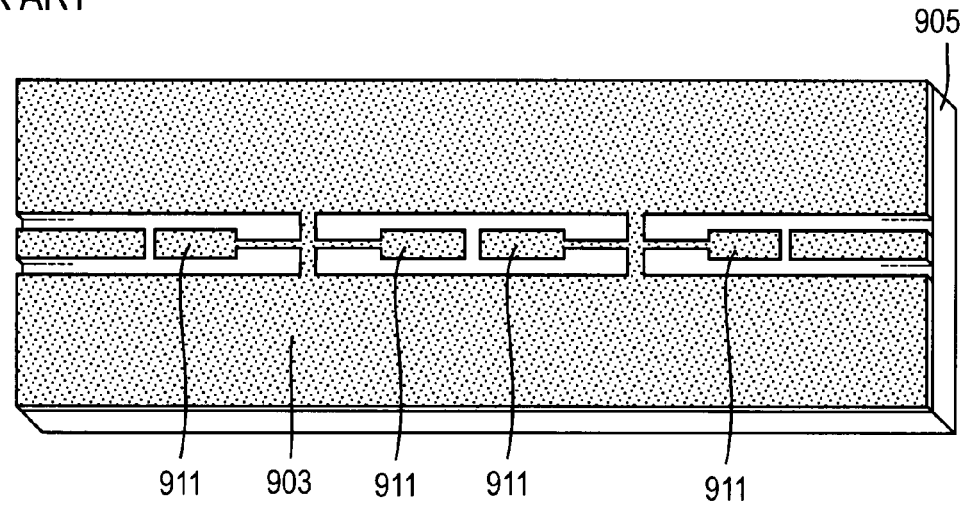
FIG. 29 PRIOR ART
FIG. 29 is a schematic perspective view of a conventional coplanar waveguide filter in the case where quarter-wavelength coplanar waveguide resonators are used.

FIGS. 26A and 26B show frequency characteristics of a coplanar waveguide filter shown in FIG. 25. The coplanar waveguide filter shown in FIG. 25 is the coplanar waveguide filter 500 shown in FIG. 22 and is designed to have a center frequency of 5 GHz and a bandwidth of 160 MHz. According to the design, the width of the center conductor 101 is 0.08 mm, the distance between the outer side edges of the short-circuited line conductor 101*a* and the line conductor 101*f* of the quarter-wavelength coplanar waveguide resonators P1 and P4 is 1.55 mm, the distance between the outer side edges of the short-circuited line conductor 101*a* and the line conductor 101*f* of the quarter-wavelength coplanar waveguide resonators P2 and P3 is 1.64 mm, and the distance between the peripheral edges 103*a* of the ground conductor 103 that are parallel to the center line conductors 101*b* is 2.88 mm. The value of the U-shaped gap width between the center conductors 101 and the base stub 104 is 0.08 mm, and the value is common to all U-shaped gap widths. The distance between the quarter-wavelength coplanar waveguide resonators P1 and P2 is 0.33 mm, the distance between the quarter-wavelength coplanar waveguide resonators P3 and P4 is 0.33 mm, and the distance between the quarter-wavelength coplanar waveguide resonators P2 and P3 is 0.54 mm.

In the graphs shown in FIGS. 26A and 26B, the abscissa indicates the frequency in GHz, the left ordinate indicates the $S_{11}$ parameter, which is the reflection coefficient, in dB, and the right ordinate indicates the $S_{21}$ parameter, which is the transmission coefficient, in dB. FIG. 26A shows frequency characteristics of the coplanar waveguide filter 500 shown in FIG. 22 in a range from 0 GHz to 25 GHz. FIG. 26B shows frequency characteristics of the coplanar waveguide filter 500 shown in FIG. 22 in a range from 4 GHz to 6 GHz. As can be seen from FIGS. 26A and 26B, the coplanar waveguide filter 500 shown in FIG. 22 meets performance requirements of a center frequency of 5 GHz and a band width of 160 MHz at FWHM. In this band, the value of the $S_{11}$ parameter abruptly decreases to be equal to or lower than −20 dB.

In the coplanar waveguide resonators and the coplanar waveguide filters described above as examples, the base stubs are formed on the both sides of the center line conductor of the center conductor. This is because, if the base stubs are disposed in symmetry with respect to the center line conductor, the computation time of the electromagnetic simulation involved in designing the resonators or filters can be reduced. However, the base stub can also be formed only one side of the center line conductor.

INDUSTRIAL APPLICABILITY

The present invention can be applied to a signal transceiver of a communication apparatus for mobile communication, satellite communication, point-to-point microwave communication or the like, for example.

What is claimed is:

1. A coplanar waveguide resonator, comprising:

a dielectric substrate;

a center conductor formed on said dielectric substrate, and having a center line conductor; and a ground conductor disposed on said dielectric substrate with a gap section interposed between respective peripheral edges of the ground conductor and respective sides of said center line conductor; wherein a short-circuited line conductor is connected at both ends thereof perpendicularly to the peripheral edges of the ground conductor;

said center line conductor at one end thereof is connected perpendicularly to a center of the short-circuited line conductor, and at the other end thereof is open-circuited, so that the center line conductor and the short-circuited line conductor constitute the center conductor in a T-shape; and the coplanar waveguide resonator further comprises, two base stubs, each base stub being formed as an extension of the ground conductor and having a first collateral line conductor, which is disposed in parallel to the center line conductor with a uniform distance from said center line conductor and is open-circuited at one end face; and a connecting line conductor, which is connected at one end as a root part of the base stub perpendicularly to the corresponding peripheral edge of the ground conductor and at the other end with the other end of said first collateral line conductor together, so that said first collateral line conductor and said connecting line conductor constitute the base stub in an L-shape.

2. The coplanar waveguide resonator according to claim 1, wherein said first collateral line conductor is positioned with respect to said center line conductor in such a manner that a resonance frequency of said center conductor is split.

3. The coplanar waveguide resonator according to claim 1, wherein said center conductor has an electrical length equivalent to a quarter wavelength at a resonance frequency thereof and has an open-circuited end.

4. The coplanar waveguide resonator according to claim 3, wherein the root part of each of said two base stubs is short-circuited to a part of said ground conductor close to the open-circuited end of said center line conductor.

5. The coplanar waveguide resonator according to claim 4, wherein each of said two base stubs further has a second collateral line conductor, which is connected at one end perpendicularly to the first collateral line conductor at the open-circuited end and extends in parallel to said short-circuited line conductor to be disposed to have a uniform distance from said short-circuited line conductor.

6. The coplanar waveguide resonator according to claim 4, wherein one or more stubs having a shape similar to the shape of said two base stubs and an electrical length shorter than an electrical length of said two base stubs at said resonance frequency are disposed in a gap section between a corresponding one of said two base stubs and said ground conductor in an interdigital and nested configuration.

7. The coplanar waveguide resonator according to claim 3, wherein the two base stubs are disposed on the both sides of said center line conductor.

8. A coplanar waveguide filter having a plurality of coplanar waveguide resonators according to claim 1 connected in series with each other in such a manner that adjacent coplanar waveguide resonators are disposed in inverted orientations.

* * * * *